US010745829B2

(12) United States Patent
Masuda et al.

(10) Patent No.: US 10,745,829 B2
(45) Date of Patent: Aug. 18, 2020

(54) CORE-SHEATH CONJUGATED FIBER, SLIT FIBER, AND METHOD OF MANUFACTURING SUCH FIBERS

(71) Applicant: Toray Industries, Inc., Tokyo (JP)

(72) Inventors: Masato Masuda, Mishima (JP); Tomohiko Matsuura, Mishima (JP); Yasunori Kanemori, Otsu (JP)

(73) Assignee: Toray Industries, Inc., Tokyo (JP)

( * ) Notice: Subject to any disclaimer, the term of this patent is extended or adjusted under 35 U.S.C. 154(b) by 256 days.

(21) Appl. No.: 15/549,890

(22) PCT Filed: Feb. 3, 2016

(86) PCT No.: PCT/JP2016/053169

§ 371 (c)(1),
(2) Date: Aug. 9, 2017

(87) PCT Pub. No.: WO2016/129467

PCT Pub. Date: Aug. 18, 2016

(65) Prior Publication Data

US 2018/0030622 A1 Feb. 1, 2018

(30) Foreign Application Priority Data

Feb. 13, 2015 (JP) ..... 2015-026481

(51) Int. Cl.

| | |
|---|---|
| ***D01F 8/04*** | (2006.01) |
| ***D01F 8/00*** | (2006.01) |
| ***D01D 5/253*** | (2006.01) |
| ***D01F 8/12*** | (2006.01) |
| ***D01F 8/14*** | (2006.01) |

(Continued)

(52) U.S. Cl.

CPC ..... *D01F 8/04* (2013.01); *D01D 5/253* (2013.01); *D01F 6/00* (2013.01); *D01F 6/60* (2013.01); *D01F 8/00* (2013.01); *D01F 8/12* (2013.01); *D01F 8/14* (2013.01); *D03D 15/00* (2013.01); *D04B 21/16* (2013.01); *D01D 5/34* (2013.01); *D04B 1/16* (2013.01)

(58) Field of Classification Search

CPC ..... D01F 8/04; D01F 8/14; D01F 8/12; D01F 8/00; D01F 6/60; D01F 6/00; D01D 5/253; D01D 5/34; D03D 15/00; D04B 21/16; D04B 1/16; D04H 1/4391; D04H 3/018

USPC ..... 264/172.1–173.17

See application file for complete search history.

(56) References Cited

U.S. PATENT DOCUMENTS 4,764,426 A * 8/1988 Nakamura ..... D01F 1/10 428/364

FOREIGN PATENT DOCUMENTS

JP 05-287613 A 11/1993
JP 07-102410 A 4/1995

(Continued)

*Primary Examiner* — Jennifer A Steele
(74) *Attorney, Agent, or Firm* — DLA Piper LLP (US)

(57) ABSTRACT

A core-sheath conjugated fiber includes two kinds of polymer, wherein the core-sheath conjugated fiber is characterized in that the core component has projected shapes having projections and grooves alternately in a cross section in a direction perpendicular to the fiber axis, the projections are formed continuously in the direction of the fiber axis, and the height (H) of the projections, the width (WA) at the tip of the projections, and the width (WB) of the bottom surface satisfy the formulas at the same time:

$$1.0 \leq H/(WA)^{1/2} \leq 3.0 \quad (1)$$

$$0.7 \leq WB/WA \leq 3.0 \quad (2).$$

6 Claims, 10 Drawing Sheets

(51) Int. Cl.

| | |
|---|---|
| ***D01F 6/60*** | (2006.01) |
| ***D01F 6/00*** | (2006.01) |
| ***D01D 5/34*** | (2006.01) |
| ***D04B 21/16*** | (2006.01) |
| ***D03D 15/00*** | (2006.01) |
| *D04B 1/16* | (2006.01) |

(56) References Cited

FOREIGN PATENT DOCUMENTS

| | | | | |
|---|---|---|---|---|
| JP | 07-102411 | A | | 4/1995 |
| JP | 07-102438 | A | | 4/1995 |
| JP | 07-109631 | A | | 4/1995 |
| JP | 09-195121 | A | | 7/1997 |
| JP | 09195121 | A | * | 7/1997 |
| JP | 2004-052161 | A | | 2/2004 |
| JP | 2004052161 | A | * | 2/2004 |
| JP | 2004-308021 | A | | 11/2004 |
| JP | 2004-339616 | A | | 12/2004 |
| JP | 2007-023423 | A | | 2/2007 |
| JP | 2008-007902 | A | | 1/2008 |
| JP | 2013-204196 | A | | 10/2013 |
| WO | 2011/093331 | A1 | | 8/2011 |
| WO | 2012/173116 | A1 | | 12/2012 |

* cited by examiner

CORE-SHEATH CONJUGATED FIBER, SLIT FIBER, AND METHOD OF MANUFACTURING SUCH FIBERS

TECHNICAL FIELD

This disclosure relates to a core-sheath conjugated fiber comprising two kinds of polymer, more specifically, a fiber wherein the core component has special cross-sectional morphology, and is adapted for use in garment textiles having high processability in the subsequent process, excellent abrasion resistance, and which pursues wearing comfort.

BACKGROUND

Fibers using a thermoplastic polymer such as polyester or polyamide have excellent mechanical properties and size stability. Accordingly, such fibers are industrially valuable, and they are widely used not only for garment use, but also for interior use, automobile interior use, and other industrial uses.

However, demands for the textile material is diverse where comfort and convenience are simultaneously pursued, and single fibers comprising a conventional polymer could not always cope with such demands. Designing a new polymer from scratch to cope with such demands is too costly and time-consuming, and use of a conjugated fiber having the features of two or more polymers has been a frequent choice. A conjugated fiber can be provided with properties that cannot be realized in a single fiber, for example, by covering the main component with another component. Accordingly, various conjugated fibers having various shapes have been proposed, and various techniques have been proposed depending on the intended use of the fiber.

Of the conjugated fibers, core-sheath conjugated fibers produced by covering a core component with a sheath component are often used in applications where effects such as texture and bulkiness and mechanical properties such as strength, modulus, and abrasion resistance that could not be realized by a single fibers are pursued. Use of such core-sheath conjugated fiber enables production of a fibers having special cross-sectional shape that could not be realized by a nozzle for single fibers. When the melt spinning of a polymer such as a polyester or polyamide is conducted, the polymer discharged from the spinning nozzle experiences high surface tension in the course of its cooling, and since the cross-section becomes circular because of the higher stability, production of a fiber having a highly complicated cross section is difficult. In the meanwhile, development of a core-sheath conjugated fiber is one direction of fiber development since a fiber having a special cross-section enables production of a fiber having unique texture that could not be realized by the fiber having a circular cross-section with increased contact area with the additional resin coating the fiber, namely, production of a fiber having various functions from the same polymer.

Examples of the fiber having a special cross-section include those proposed in Japanese Unexamined Patent Publication Nos. 2004-339616 and 2008-7902 prepared by applying the core-sheath conjugated fiber, namely, by using the technique of forming a fiber having slit-shaped continuous grooves formed in the direction of the fiber axis.

JP '616 proposes a deodorant fiber wherein slits are formed in the surface layer to increase contact area with the air compared to conventional fibers having a normal circular cross-section and, in this fiber, improved deodorant function is realized by forming such fiber from a polymer such as phosphate salt having a deodorant function.

In addition to the use of the thermoplastic polymer having a deodorant function, JP '616 attempts to realize the merit of enhancing the deodorant function by providing 20 or more slits each having a depth at least twice the groove width in the surface layer of the fiber to thereby increase surface area per unit weight of the fiber (specific surface area).

However, many deep slits reaching the inner layer of the fiber are formed in the fiber of JP '616 since increase in the specific surface area is the primary aim of JP '616 and, accordingly, that fiber may enjoy excellent initial performance when the slits are still retained. However, when the fiber is used for garment textile application wherein the fiber is subjected to abrasion and repetitive complicated deformation, provision of many deep slits becomes problematic. In other words, in JP '616, the slits are in the form of deep grooves, and formation of the projections having a shape highly durable to the abrasion is not considered and, therefore, projections formed on the surface layer of the fiber are peeled off from their base by abrasion and the like, and the peeled projections in the form of fine fluffs may adversely affect the feel and the color development and, also, the deodorant function realized by the slits may be degraded in a large way with lapse of time.

JP '902 proposes a fiber having many fine slits formed in its surface layer pursuing sharp multi-shaving effects and inner wrapping effects to provide excellent wiping performance and polishing performance with the fiber.

JP 902 uses a fiber having a diameter apparently the same as that of the conventional fibers, but formed with many fine slits, and the wiping cloths produced by using such fiber has the possibility of exhibiting the performance equivalent to the wiping cloths produced by using conventional ultrafine fibers without sacrificing the mechanical properties such as fiber strength.

However, as in JP '616, the slits of JP '902 are wedge-shaped and extend also extremely deeply to the inner layer of the fiber. Accordingly, the slits are easily peeled off when the fibers are repetitively abraded, and the fabric made from such fiber are likely to experience loss of the wiping performance in repeated use by generation and falling of the fluffs by the peeling of the projections, while there may be some possibility of using the fabric for a disposable wiping cloth. Use of such fiber for the garment textile which is likely to experience scratching and repetitive deformation in the practical use is extremely difficult.

The technology proposed in JP '616 and JP '902 pursued increase in the specific surface area of the fiber, and their use in the application where the fabric experiences scratching, abrasion, and repetitive deformation as expected for general application of garments and industrial materials was difficult although there may be possibility of using such technology in limited applications under limited conditions. More specifically, use of such technology in garment textiles where texture, feel, and color development are critical is particularly unsuitable.

Fibers for garment textile application having the slit morphology are disclosed in Japanese Unexamined Patent Publication Nos. 2004-52161 and 2004-308021. The selling points of these fibers are textures and color development realized by slit morphology.

JP '161 and JP '021 propose a technology of providing many slits having a depth of at least 2 μm in the surface layer of the fiber as a fiber capable of exhibiting squeaky texture like that of natural silk fiber and expressing a deeper color tone.

In JP '161 and JP '021, slit mobility during the crumpling and deformation in the compression direction is realized by provision of the slits each having a depth of at least twice the groove width, and the squeaky texture is realized by the thus increased friction between the fibers. It is also disclosed that the fine slits in the surface layer of the fiber suppress light diffusion on the surface layer of the fiber to realize development of deeper color tone.

While use of the fibers in the garment textile application is intended in JP 161 and JP '021, the technology disclosed therein cannot be regarded as a technology that have considered the subsequent process with repetitive application of a relatively high stress or a technology where slits with the morphology durable to the abrasion or repeated use are provided. More specifically, in the core-sheath conjugated fiber having a special cross-section, the sheath component would be peeled off by friction with the yarn guide or the reed, or the slits would be broken during the dissolution of the sheath component since the fabric undergoes complicated deformation in the treatment bath, and this may adversely affect the texture and the color development. In addition, the projections of the slits weakened by fatigue in the subsequent process is easily peeled off in the actual use to produce fine pillings, and the abraded part exhibits poor texture with rough feeling, and this invites marked loss in the quality of the fabric. Furthermore, the deeper color tone pursued in JP 161 and JP '021 is greatly harmed by diffusion of light caused by fluffs and partial whitening. As described above, most conventional slit fibers failed to consider durability in the subsequent processing and in the practical use, and they were associated with problems in actual use. Accordingly, there have been demands for a fiber having special cross-section provided with two or more slits in the surface layer, and a core-sheath conjugated fiber for producing such fiber having special cross-section at a high productivity exhibiting excellent processability in the subsequent process.

SUMMARY

We provide a slit fiber and a core-sheath conjugated fiber to produce such a slit fiber. The fiber is a highly functional textile material highly demanded in today's market where both texture and comfort are required because special texture and color tone as a textile material for garments have been realized and the fiber surface properties have become controllable. In addition, despite the special cross-section with many slits on the fiber surface layer, our fibers can be used in non-limited applications with no limitation in the conditions of use due to the high mechanical properties including the abrasion resistance and durability. Accordingly, when these fibers are used in textile products for garments, they can be fully used in a wide variety of applications from inner to the outer garments.

We thus provide:

(1) A core-sheath conjugated fiber comprising two kinds of polymer, wherein the core-sheath conjugated fiber is characterized in that the core component has projected shapes having projections and grooves alternately in a cross section in a direction perpendicular to the fiber axis, the projections are formed continuously in the direction of the fiber axis, and the height (H) of the projections, the width (WA) at the tip of the projections, and the width (WB) of the bottom surface satisfy the formulas at the same time:

$$1.0 \leq H/(WA)^{1/2} \leq 3.0 \quad (1)$$

$$0.1 \leq WB/WA \leq 3.0 \quad (2).$$

(2) A core-sheath conjugated fiber according to (1), wherein the width (WA) at the tip of the projection of the core component and distance between the adjacent projection tips (PA) satisfy the following equation:

$$0.1 \leq WA/PA \leq 0.9 \quad (3).$$

(3) A core-sheath conjugated fiber according to (1) or (2), wherein area proportion of the core component is at least 70% and up to 90% in the cross-section perpendicular to the fiber axis of the core-sheath conjugated fiber.

(4) A core-sheath conjugated fiber according to any one of (1) to (3), wherein the core component comprises a hardly soluble component and the sheath component comprises an easily soluble component, and dissolution speed ratio (sheath/core) of the polymer constituting the core component to the polymer constituting the sheath component is at least 100.

(5) A core-sheath conjugated fiber according to any one of (1) to (4), wherein the core component comprises a polymer containing 0.1% by weight to 10.0% by weight of inorganic particles.

(6) A slit fiber prepared by removing the sheath component from the core-sheath conjugated fiber according to (3), wherein the fiber has slits which are continuous in the direction of the fiber axis.

(7) A slit fiber having projected shapes having projections and grooves alternately in a cross section in a direction perpendicular to the fiber axis, the projections are continuously formed in the direction of the fiber axis, and the height (HT) of the projections, the width (WAT) at the tip of the projections, and the width (WBT) of the bottom surface satisfy the formula at the same time:

$$1.0 \leq HT/(WAT)^{1/2} \leq 3.0 \quad (4)$$

$$0.7 \leq WBT/WAT \leq 3.0 \quad (5).$$

(8) A slit fiber according to (7), wherein the projections are so formed that the distance between the adjacent projection tips (slit width WC) in the cross-section perpendicular to the fiber axis has a variation (CV %) of at least 1.0% and up to 20.0%.

(9) A slit fiber according to (7) or (8), wherein degree of irregularity of the cross sectional shape in the direction perpendicular to the fiber axis is 1.0 to 2.0.

(10) A slit fiber according to any one of (7) to (9), wherein the fiber contains a polyamide as its main component.

(11) A textile product containing the fiber according to any one of (1) to (10) as at least a part thereof.

(12) A method of producing the core-sheath conjugated fiber according to any one of (1) to (5) by using a composite nozzle for ejecting a conjugated polymer comprising at least 2 polymer components, wherein the composite nozzle comprises a metering plate having a plurality of metering holes for metering each polymer component; a distribution plate having a confluence groove where the polymer discharged from the metering hole becomes together, the confluence groove having a plurality of distribution holes provided therethrough; and a discharge plate.

(13) A method of producing a slit fiber by removing the sheath component by dissolution from the core-sheath conjugated fiber according to any one of (1) to (5).

The core-sheath conjugated fiber has a special morphology of the core component in the cross section perpendicular to the fiber axis that alternating projections and grooves are continuously formed, and this special morphology of the projection has realized unique composite cross section.

In a core-sheath conjugated fiber, the core component protrudes into the sheath component, and this results in the increased contact area between the core component and the sheath component, which prevents peeling of the sheath component from the core component in the subsequent process even in the polymer combination with low mutual affinity. Accordingly, this core-sheath conjugated fiber exhibits high processability in wide variety of conditions in the subsequent process including weaving and knitting where the fiber repetitively undergoes abrasion by yarn guide and reed or where the fiber undergoes abrasion under heat application.

When the sheath component comprising an easily dissolving polymer is removed by a solvent, a slit fiber having continuous slits formed in the fiber surface layer is formed, and since the morphology of these slits are designed on mechanical viewpoints, the projection stands by itself after the sheath dissolution, and collapse of the projection morphology is greatly reduced. Accordingly, the fiber is resistant to scratching and deformation in compression direction, and the fiber also enjoy durability to the abrasion which has been long awaited.

The core-sheath conjugated fiber and the slit fiber produced by using the core-sheath conjugated fiber for the starting material exhibits various characteristic features by the slits formed on the fiber surface layer without compromising the durability and, accordingly, the fiber can be developed in a wide variety of applications which the prior art technology could not cope with.

EXPLANATION OF NUMERALS

Figure 1:
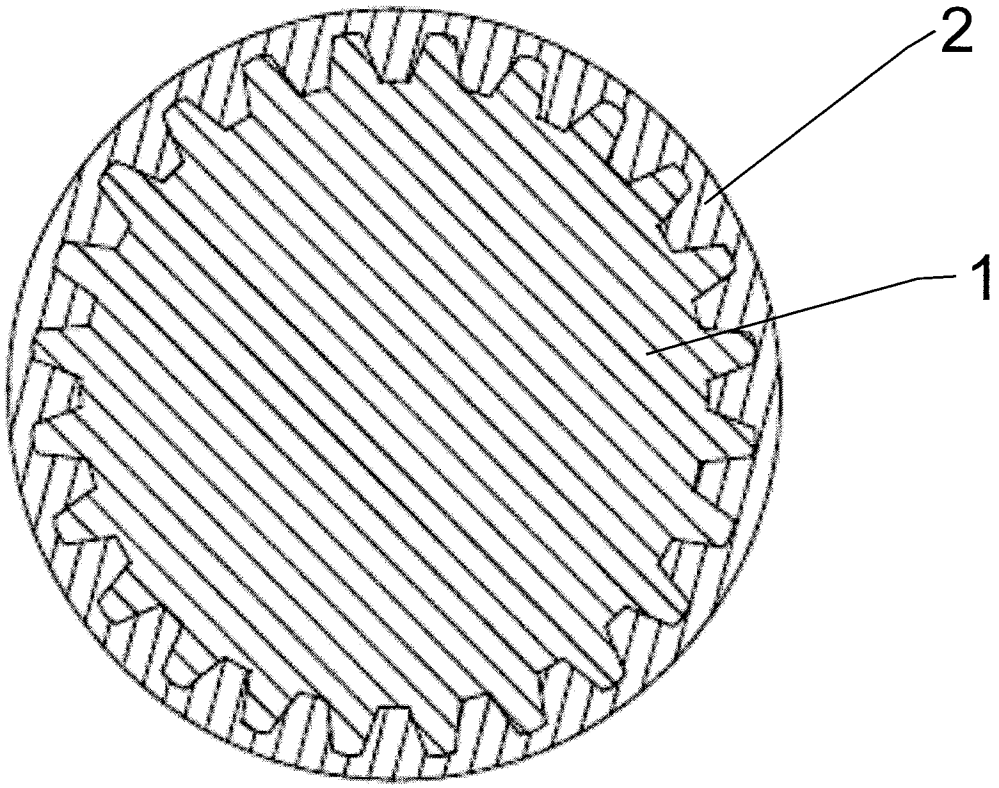
FIG. 1 is a schematic view showing the core-sheath conjugated fiber.

1: core component
2: sheath component
3: circumcircle of the projection
4: extension line of the projection side surface
5: center line of the projection side surface
6: intersecting point of the circumcircle and the center line
7: intersecting point of the circumcircle and the extension line
8: inscribed circle of the groove
9: intersecting point of the inscribed circle and the center line
10: intersecting point of the inscribed circle and the extension line
11: metering plate
12: distribution plate
13: discharge plate
14: metering hole
14-1: metering hole for core component
14-2: metering hole for sheath component
15: distribution groove
16: distribution hole
16-1: distribution hole for core component
16-2: distribution hole for sheath component
17: discharge-introductory hole
18: thinning hole
19: discharge hole

DETAILED DESCRIPTION

Next, our fibers slit fibers and methods are described in further detail by referring to the preferred examples.

The core-sheath conjugated fiber is a fiber comprising two kinds of polymer having a cross-sectional morphology such that the sheath component covers the core component in the cross-section in the direction perpendicular to the fiber axis.

The core component and the sheath component constituting the core-sheath conjugated fiber may be prepared from a polymer which can be molded by melting, and exemplary such polymers include polyethylene terephthalate, polyethylene naphthalate, polybuthylene terephthalate, polytrimethylene terephthalate, polypropylene, polyolefin, polycarbonate, polyacrylate, polyamide, polylactic acid, thermoplastic polyurethane, and polyphenylene sulfide and copolymers thereof. More specifically, the polymer may have a melting point of at least 165° C. in view of the improved heat resistance. The polymer may also contain an inorganic substance such as titanium oxide, silica, or barium oxide, a colorant such as carbon black, dye, or pigment, or other additives such as flame retardant, fluorescent brightener, antioxidant, or UV absorbent. When the core component polymer contains inorganic particles, diffusion and reflection of visible light and the like at a very high level is realized by the synergetic effect of the incorporation of the inorganic particles and the special slit morphology formed by the core component of the fiber. While there have generally been single fibers and simple core-sheath conjugated fibers (with the core component having a circular cross-section) prepared by using a polymer containing inorganic particles, use of a polymer having an excessive amount of the inorganic particles incorporated was necessary if anti-see-through effect was to be realized. Use of such polymer may result in the considerable loss of color development, and use of such technique may be difficult in the case of the textile product requiring the excellent color development. In our core-sheath conjugated fiber, excessive incorporation of the inorganic particles in the core component polymer is not necessary and, when the sheath component is not removed by dissolution and an easily dyable polymer is used for the sheath component, the resulting fiber will simultaneously exhibit contradictory properties of excellent color development and anti-see-through property which could not be simultaneously realized in the conventional fibers. When such diffusion and reflection of the visible light and the like are to be achieved, 0.1% by weight to 10.0% by weight of inorganic particles is preferably incorporated in the core component polymer. When the content is in such range, an excellent light reflection and, also, stable production of the fiber are enabled. In view of realizing the high color development, production with good balance between the inorganic particles content and the proportion (thickness) of the sheath component is preferable. Content of the inorganic particles in the range of 1.0% by weight to 7.0% by weight is more preferable in view of the light reflection and the color development. The term "inorganic particles" as used herein designates inorganic substance such as titanium oxide, silica, or barium oxide in the form of particles. Of the inorganic particles as mentioned above, use of titanium oxide is preferable in view of the handling convenience, and the most preferred is the use of anatase-type having the maximum particle size of 5.0 μm with the proportion of those having the particle size of up to 1.0 μm of up to 50% by weight.

In the core-sheath conjugated fiber, a slit fiber solely comprising the core component can be obtained by dissolving the sheath component after the subsequent process such as weaving and knitting. In this case, the core component is preferably less soluble and the sheath component is preferably more soluble compared to the solvent used for the dissolution of the sheath component. More specifically, it is preferable that the core component is first chosen depending on the intended use of the fiber, and then, the sheath component is chosen from the polymers as mentioned above in view of the solvent that can be used. In this process, the combination of the hardly soluble component (core component) and the easily soluble component (sheath component) will be more preferable when the ratio of the speed of the dissolution in the solvent of the hardly soluble component (core component) to the easily soluble component (sheath component) is higher, and the dissolution speed ratio (sheath/core ratio) is preferably at least 100. In this point of view, a higher dissolution speed ratio is preferable since dissolution of the sheath can be completed without unnecessary deterioration of the core component, and the dissolution speed ratio is preferably at least 1000, and most preferably at least 10000.

The term "dissolution speed ratio (sheath/core ratio)" as used herein is the ratio of the dissolution speed of the core polymer to the dissolution speed of the sheath polymer in the condition (the type of the solvent and the temperature) used for the dissolution of the sheath, and this dissolution speed is the speed constant calculated from the dissolved amount per unit time in such dissolution condition. The dissolution speed ratio is determined by dividing the dissolution speed of the sheath polymer by the dissolution speed of the core polymer, and rounding off from the first decimal place. More specifically, small pieces of each polymer are treated for 5 hours in a hot air dryer adjusted to a temperature not higher than the temperature 100° C. higher than the glass transition temperature of each polymer. Next, the pieces are inserted in the solvent maintained at the temperature used for the dissolution so that the bath ratio is 20, and the dissolution speed of each polymer is calculated from the dissolution amount per unit time of the heat treated pieces in this dissolution treatment.

The sheath component is preferably selected from polymers which can be molded by melting and which exhibits higher dissolvability than the other component, for example, a polyester and copolymers thereof, polylactic acid, polyamide, polystyrene and copolymers thereof, polyethylene, polyvinyl alcohol and the like. In view of simplifying the dissolution step of the sheath component, the sheath component is preferably a copolymerized polyester, a polylactic acid, a polyvinyl alcohol, or the like which is easily soluble to an aqueous solvent or hot water, and more particularly, the sheath component is preferably a polyester prepared by polymerizing or copolymerizing polyethylene glycol and/or sodium sulfoisophthalic acid or polylactic acid in view of handling convenience and easy dissolution to a low concentration aqueous solvent.

Polylactic acid, a polyester having 3 mol % to 20 mol % of 5-sodium sulfoisophthalic acid copolymerized therewith, and a polyester having 5 wt % to 15 wt % of polyethylene glycol having a weight average molecular weight of 500 to 3000 copolymerized therewith in addition to the 5-sodium sulfoisophthalic acid as described above are most preferable in view of dissolvability in the aqueous solvent and simplifying the treatment of the waste generated in the dissolution. In particular, the polyester having solely 5-sodium sulfoisophthalic acid copolymerized therewith, and a polyester having polyethylene glycol copolymerized therewith in addition to the 5-sodium sulfoisophthalic acid as described above exhibit high dissolvability in aqueous solvents such as alkaline aqueous solution without losing the crystallinity, and they are preferable in view of processability in the subsequent process since fusion of the conjugated fibers do not occur in the false twisting step where fibers are abraded at elevated temperature.

In such removal of the sheath component by the dissolution with the alkaline aqueous solution, the core component is preferably composed from a polyamide having high alkaline resistance. The term "polyamide" as used herein is preferably polycaproamide (nylon 6) or polyhexamethylene adipamide (nylon 66) having excellent mechanical properties which is adapted for use in textile applications, and more preferably polycaproamide (nylon 6) in view of less likeliness to undergo gelation in the course of the spinning and the excellent spinnability. Exemplary other components include polydodecanoamide, polyhexamethylene adipamide, polyhexamethylene azelamide, polyhexamethylene sebacamide, polyhexamethylene dodecanoamide, polymethaxylylene adipamide, polyhexamethylene terephthalamide, and polyhexamethylene isophthalamide.

Polyamide is known to have a relatively high softness, and it is also known to exhibit an excellent abrasion resistance. In the slit fiber, the self-standing slit shape inherently has durability to abrasion, and use of the polyamide realizes an extremely high abrasion resistance. In addition, polyamide has excellent hydrophilicity, and therefore, when the slit fiber is used as a water-absorbing fiber, the water absorption by the capillary phenomenon of the slits is enhanced, and the resulting fiber can be used as a unique ultra-water absorbing fiber.

In the core-sheath conjugated fiber, the core component is required to have projected shapes having alternating continuously-shaped projections and grooves in the cross-section of the fiber illustrated in FIG. 1 comprising the core component and the sheath component comprising the polymers as described above. The projections and grooves of the core component are alternately arranged along the periphery of the core component cross-section, and the height (H) of the projection, width (WA) at the tip of the projection, and width (WB) of the bottom surface are required to simultaneously satisfy equations (1) and (2), and these ratios are determined as described below:

$$1.0 \leq H/(WA)^{1/2} \leq 3.0 \quad (1)$$

$$0.7 \leq WB/WA \leq 3.0 \quad (2).$$

More specifically, a multifilament comprising the core-sheath conjugated fibers is embedded in an embedding agent such as epoxy resin, and the cross-section of these embedded fibers is observed by using a scanning electron microscope (SEM) at a magnification capable of observing at least 10 projections protruding from the core component into the sheath component to thereby obtain two-dimensional pictures. When metal dying is conducted in this step, contrast between the core component and the sheath component can be clarified by using the difference in the degree of staining between the core component polymer and the sheath component polymer. By using the thus taken pictures, the randomly chosen 10 projections in the same picture were measured for their projection height (H), width of the tip (WA), and width of the bottom surface (WB) by the unit of μm, and the measurements were round to the first decimal place. By repeating the procedure as described above for 10 times, the values for the 10 pictures were determined in terms of simple average which has been rounded to the first decimal place.

Figure 2:
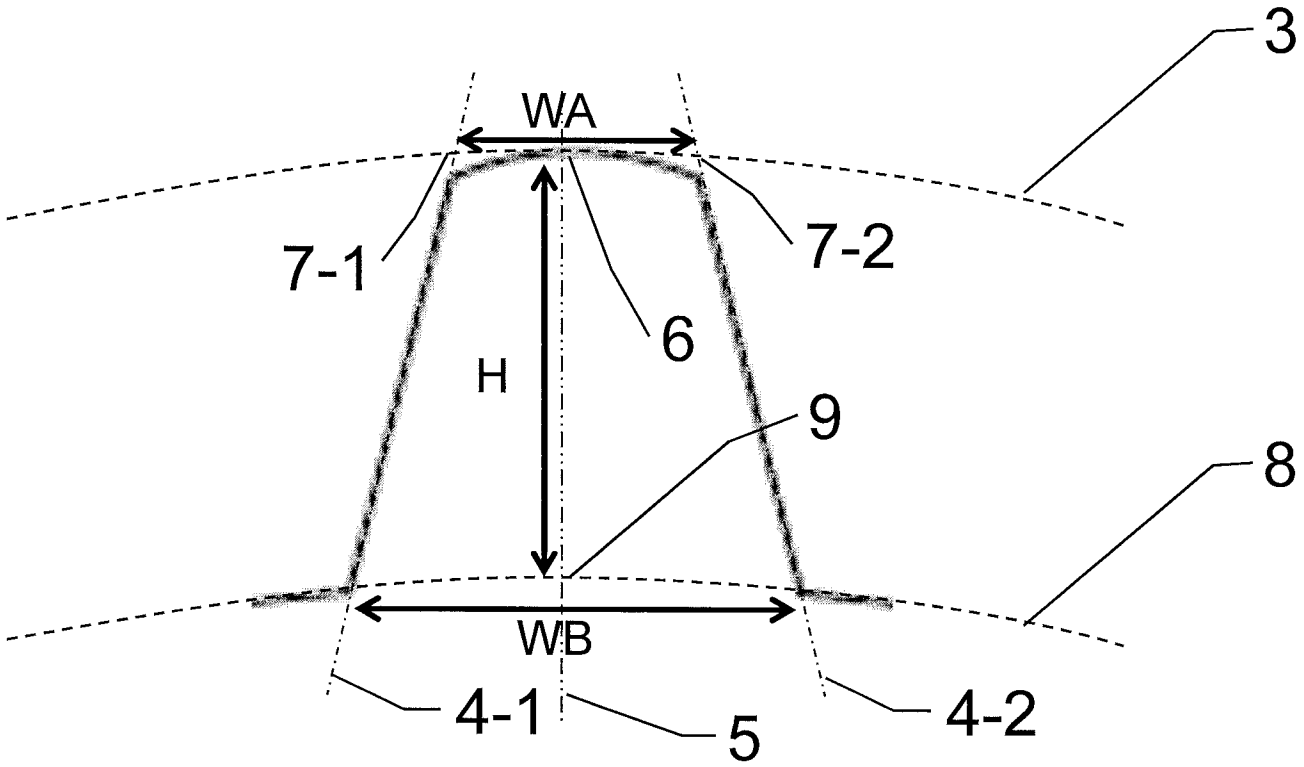
FIG. 2 is a partially enlarged schematic view of the core component showing the projection of the core component.

To improve processability in the subsequent process and form the projection morphology with high durability in this stage, ratio of the parameters of the projection morphology is important, and this ratio is described in further detail by referring to FIG. 2.

In the core-sheath conjugated fiber, the relation between the height (H) of the projection and width (WA) of the projection tip is important, and this relation is the primary requirement.

The height (H) of the projection is determined by the procedure as described below.

Namely, the height (H) of the projection means the distance between the intersecting point (6 in FIG. 2) of the center line of the projection side surface (5 in FIG. 2) and the circumcircle of the projection and the intersecting point (9 in FIG. 2) of the inscribed circle of the groove and the center line of the projection side surface in the cross-section of the core-sheath conjugated fiber. Also, the width (WA) at the projection tip means the distance between the intersecting points (7-1 and 7-2 in FIG. 2) of extension lines (4-1 and 4-2 in FIG. 2) of the projection side surface and the circumcircle in the cross-section of the core-sheath conjugated fiber. The "circumcircle" as used herein is the perfect circle (3 in FIG. 2) which contacts the projection tips most frequently at two or more points in the cross-section of the core-sheath conjugated fiber, and the inscribed circle is the perfect circle (8 in FIG. 2) which contacts the groove bottom ends most frequently at two or more points in the cross-section of the core-sheath conjugated fiber.

The ratio of the projection height (H) to the square root of the tip width (WA) reflects mechanical durability of the slits, and this value should be at least 1.0 and up to 3.0.

The core-sheath conjugated fiber may be used as a slit fiber by removing the sheath component by dissolution to leave the slit fiber comprising the core component having the slit morphology. This removal of the sheath component by dissolution is typically conducted by using a fluid dyeing machine, and in this process, the fiber repetitively undergoes complicated deformation. In this case, the slits formed in the outermost layer of the fiber repetitively experiences the complicated deformation, and the projections may be readily peeled off when the mechanical durability is insufficient. In such case, the fiber will lose its texture by fluffing of the fiber and the functions that would have been realized by the slit morphology will be rarely realized without realizing the intended merits. The durability is dependent on the relation between the width of the projection tip and the projection height, and it is important that $H/(WA)^{1/2}$ is at least 1.0 and up to 3.0. When the $H/(WA)^{1/2}$ is within such range, not only the durability during the dissolution treatment but also self-standing of the slit structure after the dissolution will be realized, and this advantageously works for the realization of the functions dependent on the slit morphology, and realization of various properties is enabled by the slits formed in the surface layer. In view of the situation as described above, a smaller value of the $H/(WA)^{1/2}$ will be advantageous for the durability, and $H/(WA)^{1/2}$ is more preferably at least 1.0 and up to 2.4 to produce a highly durable slit fiber from the core-sheath conjugated fiber. When the slit fiber is used for outer wear of the sport gear used in a relatively severe environment or inner wear experiencing frequent abrasion, $H/(WA)^{1/2}$ is most preferably at least 1.0 and up to 1.8, and when $H/(WA)^{1/2}$ is in such range, the performances dependent on the slit will be retained at a high level.

In addition, this self-standing slit remains substantially unmoved upon application of abrasion and other stress, and accordingly, this slit is less likely to experience mechanical degradation, and this has considerable influence on the durability in the actual use. The use of the slit fibers having the slit morphology in the fiber surface layer is certainly proposed in JP '616, JP '902, JP 161 and JP '021. Those conventional slits, however, had problems to be solved in actual use including the prolonged use since these fibers were not prepared for repetitive abrasion or compression deformation, and use of these fibers for garment application and the like where repetitive use of the fabric is intended had been difficult except that there is some possibility of disposable wiping cloth or the like. In other words, the peeling of the slits generated by exterior force resulted in the fluffs, and the resulting fine naps invited deterioration of texture and color development, and practical use had been difficult. More specifically, the properties of those fibers depended on the presence of the slits and, accordingly, intended performance was greatly reduced in slit loss and those fibers could not endure long-term use.

Figure 3:
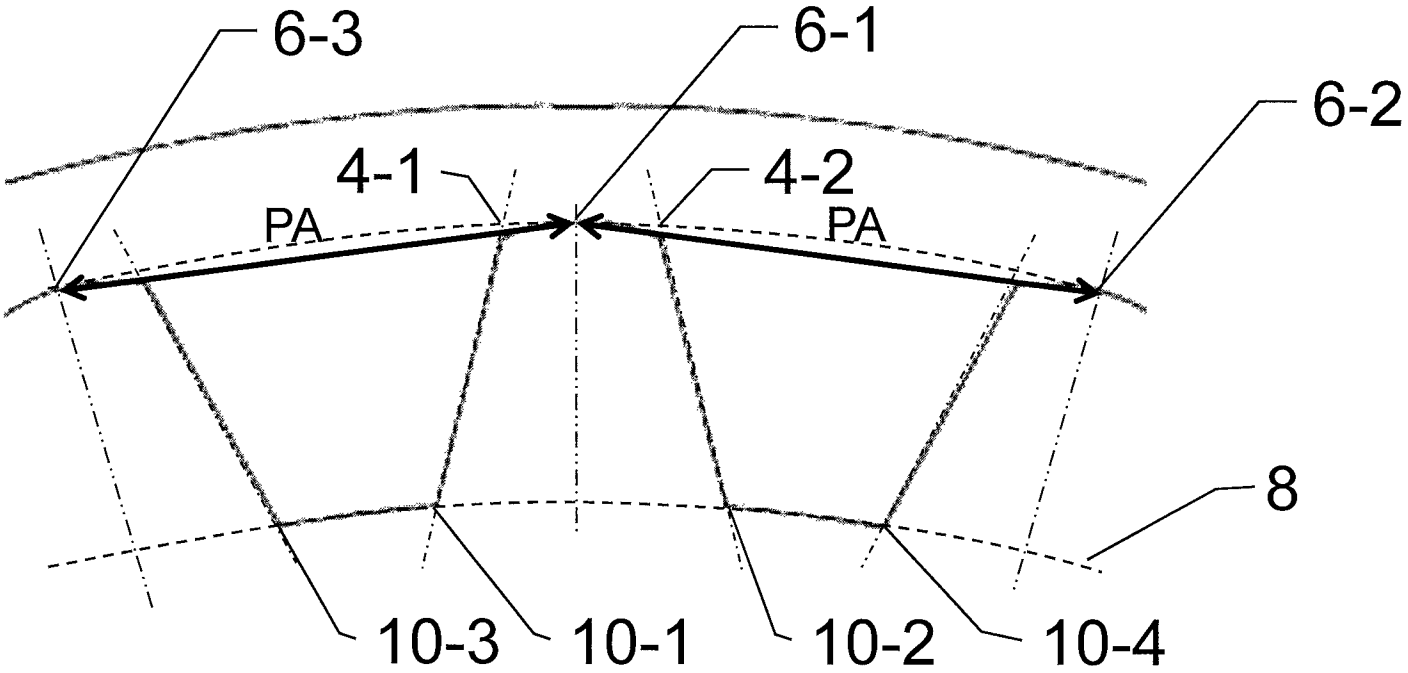
FIG. 3 is a schematic view showing projections of the core component.

In view of the durability after the dissolution treatment, the slit morphology is preferably such that the projection is tapered toward the tip, and in such point of view, the ratio (WB/WA) of the width at the projection tip (WA) to the width of the projection bottom (WB) should be at least 0.7 and up to 3.0. The term "WB" as used herein means the distance between the intersecting points of the extended line of the projection side surface and the inscribed circle of the groove (distance between 10-1 and 10-2 in FIG. 3). While provision of projections having WB/WA in excess of 3.0 may be possible, practical upper limit is set at 3.0.

This WB/WA may be adjusted depending on the desired property and intended application, and when the fiber is used for outer garments, consideration for the durability of the slits should become necessary and a higher durability against abrasion and the like should be considered in the case of sports gear used in relatively severe conditions. In such case, the WB/WA is preferably at least 1.0 and up to 3.0.

Our method of producing the core-sheath conjugated fiber finally produces a fiber having slit morphology in the surface layer of the fiber by dissolving the sheath component in the subsequent process. Accordingly, dissolution of the sheath component preferably proceeds at a high efficiency, and this relates with the width (WA) at the projection tip and the distance between the adjacent projection tips (PA). The distance (PA) between the adjacent projection tips is the distance between the intersecting points (6 in FIG. 2) of the center line (5 in FIG. 2) and the circumcircle of the adjacent two projections, and more specifically, the distance between 6-1 and 6-2 or the distance between 6-1 and 6-3 in FIG. 3.

In the core-sheath conjugated fiber, the ratio (WA/PA) of this width (WA) at the projection tip to the distance (PA) between the adjacent projection tips is preferably at least 0.1 and up to 0.9. This WA/PA corresponds to the proportion of width at the projection tip in the distance between the two adjacent projection tips in the projections, and this ratio has great influence on the dissolution efficiency of the sheath component. More specifically, the solvent used to dissolve the sheath component starts the dissolution from the outermost layer of the core-sheath conjugated fiber and the dissolution gradually proceeds to the interior of the fiber, and consequently, the sheath component located at the outermost layer of the core-sheath conjugated fiber is swiftly dissolved immediately after the start of the dissolution step, and the dissolution efficiently proceeds until the sheath component is left in the groove of the core component. However, the sheath component in the grooves then becomes surrounded by the core component, namely, by the hardly soluble component, except for the outermost layer, and this is the reason why the dissolution efficiency greatly drops when the morphology of the projections and the grooves is not considered. When the dissolution efficiency drops, elongation of the dissolution step, elevation of the dissolution temperature, and in some case, treatment by the use of stronger solvent would become necessary. Accordingly, there has been the risk that the projections formed from the core component are deteriorated and durability in the subsequent step is reduced. Another concern is quality of the fabric since the sheath component left undissolved or the residue of the dissolved sheath component may remain in the final product causing powdering and uneven dying as adverse effects.

With regard to the projections of the fiber surface layer, it has been generally believed that the dissolution treatment efficiently proceeds when the groove width is smaller since capillary phenomenon is induced with the improvement in the hydrophilicity. However, progress of the actual dissolution treatment was often associated with the phenomenon as described above. We found the phenomenon as described below. More specifically, we found that, when the projection and the groove are locally examined, the treatment by the solvent proceeds from the outer layer to the inner layer of the fiber, and when the dissolution treatment proceeds to the inner layer of the groove, the capillary phenomenon as described above that has occurred invited the residence of the solvent that had been deteriorated in the dissolution of the sheath component. This prevents contact of the new solvent with higher performance with the sheath component, inviting great drop of efficiency in the dissolution treatment. It has been the problem that this phenomenon becomes severer as the dissolution proceeds into the inner layer of the groove. The decrease in the dissolution efficiency is highly dependent on the proportion of the projection tip in the distance between the adjacent projections, in the investigation to solve this problem, and it has been found that the WA/PA is preferably at least 0.1 and up to 0.9. When the WA/PA is in such range, dissolution of the sheath component can be accomplished while suppressing the decrease in the dissolution efficiency of the sheath component and also suppressing loss of the dissolution treatment performance. In this point of view, the WA/PA is preferably at least 0.1 and up to 0.5 to facilitate discharge of the sheath component residue remaining in the groove inner layer and to reduce the time required for completion of the dissolution treatment. When the WA/PA is in such range, the dissolution treatment can be accomplished in simple manner without unnecessary deterioration of the projections of the core component, and this is also favorable in view of the fabric quality and durability. To prevent such deterioration of the projection, the groove preferably has an adequate width, and in consideration of the durability after the dissolution, WA/PA is more preferably at least 0.2 and up to 0.5.

To enable use of the core-sheath conjugated fiber in the state of a conjugated fiber under severe conditions and conduct the subsequent process with other material, the ratio (DA/PA) of the diameter (DA) of the circumcircle of the projection tip of the core component to the distance between adjacent projections (PA) is preferably in the defined range. The diameter (DA) of the circumcircle of the projection tip as used herein is the diameter of the perfect circle (3 in FIG. 2) which contacts the projection tips most frequently at two or more points in the cross-section of the core-sheath conjugated fiber, and this diameter is used for calculation of the ratio to the distance (PA) between the projection tips as described above.

DA/PA means that the projection and the groove at the surface layer of the core component are repetitively present at the interval corresponding to the diameter of the core component. More specifically, when the core component has projections protruding into the sheath component side, interface area per unit weight will be increased and, accordingly, the fiber will have a higher durability to peeling. In the meanwhile, with regard to the anchor effect, provision of an excessive number of projections may result in an unnecessarily complicated morphology which may result in the concentration of the force applied to the interface and the peeling may start from the point of such concentration while provision of an excessively low number of projections may detract from the anchor effect. In particular, in the scratching associated with the fiber deformation or in the compressive deformation, the force is likely to be applied to the interface between the core component and the sheath component where bond between molecules is relatively weak. Accordingly, the projection should be present at an interval corresponding to the core component substantially subject to such deformation and with the projection should also have the morphology as described below.

More specifically, our slit fiber is most often produced by realizing the conjugation by using different polymers having different composition, density, and softening temperature with different dissolution rate as described above, and the anchor effect plays an important role in suppressing the peeling between the core component and the sheath component. As described above, we found that the anchor effect and suppression of the concentration of the stress to the interface and, hence, excellent effects of suppressing the peeling are realized when the DA/PA is at least 3.5 and up to 15.0. In other words, the peeling often found in the abrasion with the yarn guide and the reed in the weaving and knitting is greatly suppressed when the DA/PA is at least 3.5. This effect of suppressing the peeling by the anchor effect is also very effective in suppressing the peeling in the case of insufficient affinity and also in suppressing the peeling often found in the heated false twisting of the core-sheath conjugated fiber comprising different polymers. In this point of view, the DA/PA is more preferably at least 7.0. In the meanwhile, the DA/PA is up to 15.0. When the DA/PA is in such range, peeling caused by provision of the excessive slits can be suppressed and, also, excessively complicated cross-section of the core component is also prevented and, therefore, the core-sheath conjugated fiber can be designed with high design freedom in the polymer selection.

The core-sheath conjugated fiber can be first produced into a wide variety of intermediate products such as taken-up fiber package, tow, cut fiber, wool, fiber ball, chord, pile, and woven, knitted, and non-woven fabric, and the sheath component may then be removed by dissolution to form slits on the fiber surface layer to thereby produce various textile products. The core-sheath conjugated fiber can also be produced into textile products with no further treatment, with partial dissolution of the sheath component, or with dissolution of the core component. The term textile products as used herein include not only the general garments such as jacket, skirt, pants, and underwear but also sport gear, garment material, interior products such as carpet, sofa, and curtain, automobile interior products such as car sheet, life products and abrasion cloth such as cosmetic commodity, cosmetic masks, wiping cloth, health products, environmental and industrial materials such as filter, products for removing toxic substance, battery separator, medical applications such as suture, scaffold, artificial blood vessel, and blood filter.

In consideration of the utilization of the fiber in such textile products, the sheath component is basically removed by dissolution. Accordingly, the core-sheath conjugated fiber preferably has area ratio of the core component in the cross-section of the fiber of 70% to 90%. When the area ratio is in such range, the gap between the slit fibers will be adequate and the slit fiber will be usable without mixing with other fibers, for example, in the use as a woven fabric. In view of reducing the dissolution treatment time, lower area ratio of the sheath component is preferable and, more preferably, the core component ratio is 80% to 90%.

The core-sheath conjugated fiber can be produced so that the conjugated fiber has an area ratio of the core component exceeding 90%. However, the upper limit is set at 90% as a range substantially capable of stably covering the core component with the sheath component.

As described above, with regard to the core-sheath conjugated fiber, the slit fiber is produced by first producing an intermediate product, and then dissolving the sheath component to produce the slit fiber. The thus produced slit fiber enjoys color-deepening effects by the optical effects of the slit and control of water-related properties such as water absorbency and water repellency.

The control of the water-related properties and color-deepening effects as described above are realized by the slits formed in the surface layer of the fiber. Accordingly, it is critical that the slit morphology is stable, and the slit morphology is retained after removal of the sheath component from the core-sheath conjugated fiber. Therefore, in the slit fiber, the projections continuously formed in the direction of the fiber axis should have the height (HT), the tip width (WAT), and the bottom width (WBT) of the projection satisfying equations (4) and (5) at the same time:

$$1.0 \leq HT/(WAT)^{1/2} \leq 3.0 \quad (4)$$

$$0.7 \leq WBT/WAT \leq 3.0 \quad (5).$$

As in the evaluation of the cross-section of the core-sheath conjugated fiber, the projection height (HT), width at the tip (WAT), and width of the bottom surface (WBT) of the projection are measured by embedding a multifilament comprising the slit fibers in an embedding agent such as epoxy resin, and observing the cross-section of these embedded fibers by using a scanning electron microscope (SEM) at a magnification capable of observing at least 10 projections to thereby obtain two-dimensional pictures. By using the thus taken pictures, the randomly chosen 10 projections in the same picture were measured for their projection height (HT), width at the tip (WAT), and width of the bottom surface (WBT) by the unit of μm, and the measurements were round off to the first decimal place. By repeating the procedure as described above for 10 times, the values for the 10 pictures were determined in terms of simple average which has been rounded to the first decimal place.

For stable realization of the characteristic features of the slit fiber, the slit width is preferably not uneven, and in the slit fiber, variation (CV %) of the slit width is preferably 1.0% to 20.0%.

Figure 4:
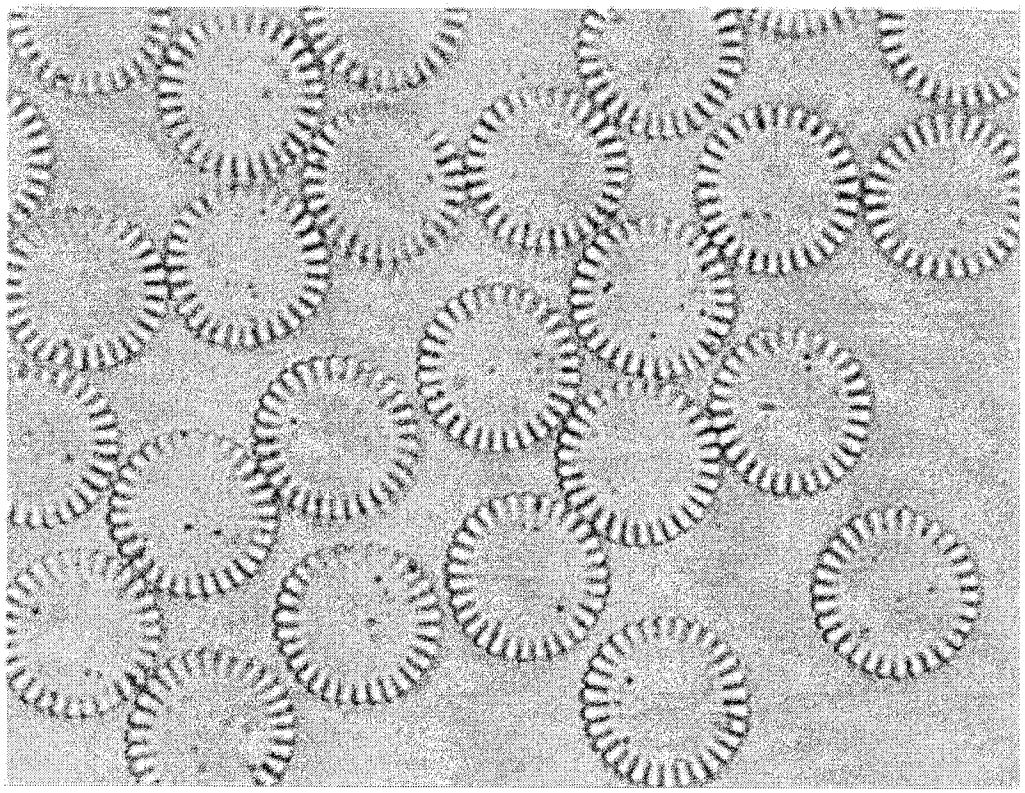
FIG. 4 is a photograph of the cross-section of the slit fiber.
Figure 10:
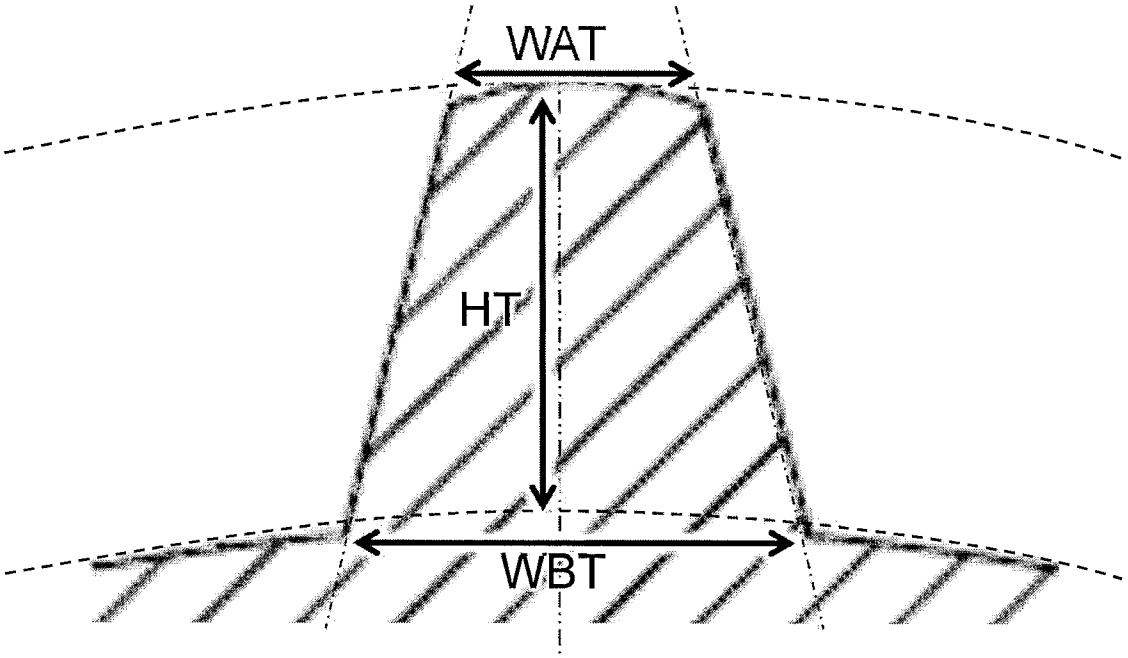
FIG. 10 is a schematic view showing projections of the slit fiber.

The slit width as used herein is determined by taking an image of the cross-section of the slit fiber as shown in FIG. 4 with a scanning electron microscope (SEM) at a magnification allowing observation of at least 10 slits. The slit width (WC) used is the value measured by using randomly chosen 10 slits from the same image of the images taken by SEM, and more specifically [(the distance between the adjacent projection tips, for example, PA in FIG. 3)—(the width of the projection tip, for example, WA in FIG. 2 or WAT in FIG. 10)]. When the at least 10 slits cannot be observed in 1 slit fiber, at least 10 slits in total may be observed by including the slits of other slit fiber. The slit width is measured at a unit of μm, and the value measured is rounded to the first decimal place. The procedure as described above is repeated for the 10 images taken, and simple number average of the values measured was calculated. The variation of the slit width is determined from the values of the slit width measured for the 100 measured slits, and the variation of the slit width is calculated from the average and standard deviation of the slit width as [(Slit width CV %)=(standard deviation of the slit width/average of the slit width)×100(%)]. The value measured by the procedure as described above is used for the variation of the slit width, and the value is rounded to the first decimal place.

It is this variation of the slit width that guarantees the variation of the performance realized by the special slit morphology. For the slit fiber, the variation of the slit width is preferably 1.0% to 20.0%, and stable realization of the function will be secured when the variation is within such range. More specifically, when the intended merit is the water absorption realized by the slit morphology, the variation of the slit width is preferably 1.0% to 15.0% when the slit fiber is to be used in a comfortable inner garment pursuing the water absorption since the water absorption performance is affected by the partial slit width difference.

The slit fiber exhibits extremely unique functions when the ratio (WC/DC) of the slit width (WC) to the fiber diameter (DC) corresponding to the diameter of the circumcircle is at least 0.02 and up to 0.10.

The fiber diameter (DC) of the slit fiber as used herein is the diameter of the perfect circle which contacts the cross-section most frequently at two or more points in the cross-section of the slit fiber in the direction perpendicular to the fiber axis in the two-dimensionally taken image as shown in FIG. 4. This fiber diameter (DC) is measured by embedding a bundle of the slit fiber in an embedding agent such as epoxy resin, slicing the embedded fiber, taking images of the cross-section with a stereomicroscope at a magnification capable of observing 10 or more fibers (FIG. 4), randomly choosing 10 fibers in the same image of the images taken, measuring the circumcircle of the fiber in the unit of μm, rounding the measurement to the first decimal place, repeating the procedure as described above for the 10 images taken, and calculating the simple number average of value measured in each image and its ratio (WC/DC).

The slit fiber exhibits excellent water absorbency since capillary phenomenon occurs depending on the slit morphology and water is sucked along the slit in the direction of the fiber axis when the fiber is used with no further treatment, whereas the slit fiber exhibits excellent water repellency since the phenomenon of water discharge from the slit occurs when the fiber is subjected to water repellent treatment. These phenomena can be divided by the contact angle of the material present on the slit surface, and the fiber exhibits water absorption when the material has a contact angle of less than 90° while the fiber exhibits water repellency when the material has a contact angle in excess of 90°. This finding is extremely important since a highly functional material simultaneously having the contradictory functions of water absorption and water repellency can be produced, for example, by subjecting some parts of a fabric to water-repellent treatment.

Garments are often required to have perspiration-absorbing and quick-drying properties in consideration of comfort inside the garment. Most water absorbing materials such as cotton used for inner garments had the feature that the absorbed moisture is retained in the fiber or between the fibers, and the fabric itself became wet, and such damp garment was uncomfortable, for example, after exercising for a while or other perspiring occasion. To realize the perspiration-absorbing and quick-drying properties, the perspiration absorbed should be quickly discharged to the exterior of the garment, and the fiber should have excellent water absorption simultaneously with excellent water repellency, and the slit fiber having the unique properties as described above is quite effective as a perspiration-absorbing and quick-drying material. In view of the balance between the water absorption and the water repellency, the WC/DC is more preferably at least 0.04 and up to 0.08. When the WC/DC is in such range, production of a highly functional material exhibiting the excellent water absorption at least twice higher than conventional materials is possible, also allowing water repellent treatment with no unevenness may become possible.

Figure 5B:
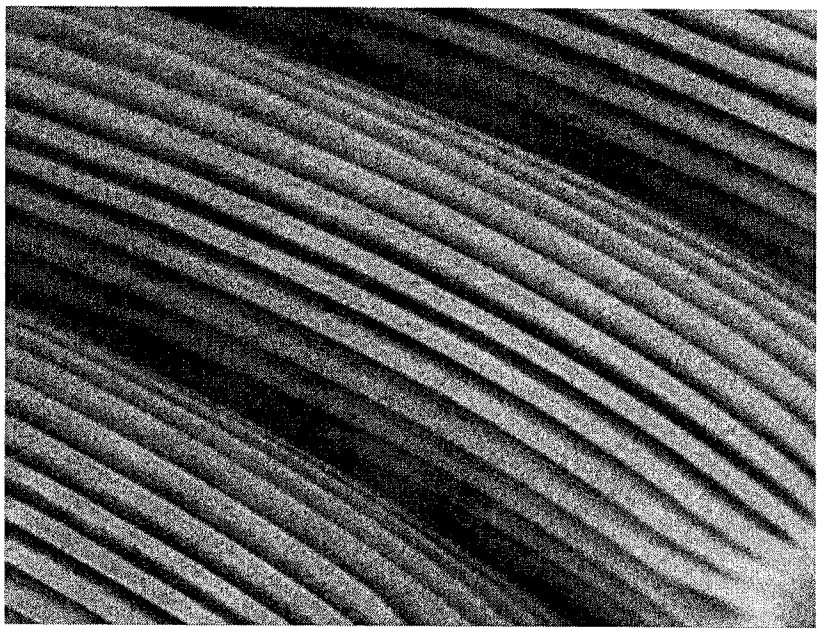
FIG. 5(*a*) is a photograph of the cross-section of the slit fiber, and FIG. 5(*b*) is a photograph of the side of the slit fiber.
Figure 5A:
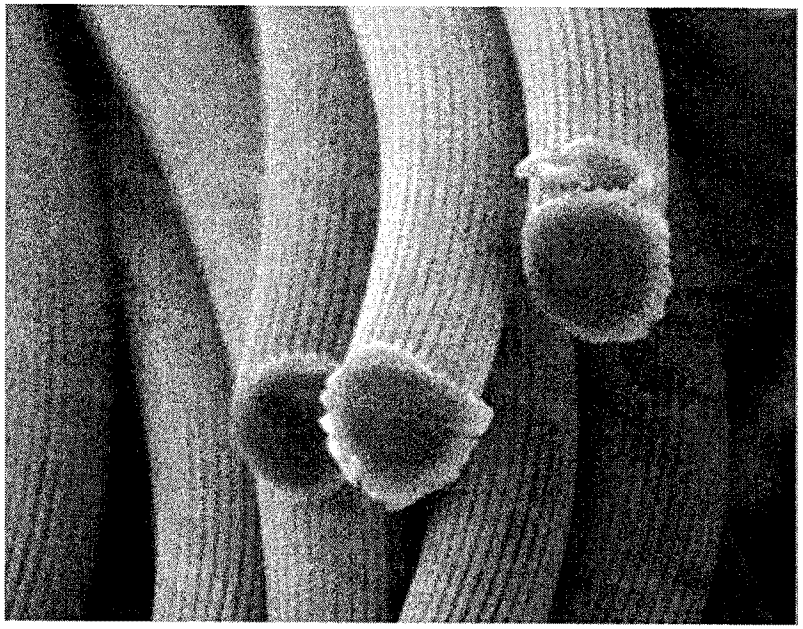

Cross-section of the slit fiber is not limited to perfect circle and exemplary shapes include flat cross-section with the ratio of the minor axis to the major axis (flatness) of 1.0 or higher, polygonal cross-sections such as triangle, quadrilateral, hexagon, and octagon, dumbbell shape with partially concave and convex parts, Y-shape, star shape, and various other cross-sectional shapes, and such cross-sectional shape enables control of surface properties and mechanical properties of the fabric. However, utilization of the gaps between fibers is preferable when the property pursued is water absorption, and in this point of view, the slit fiber preferably has a degree of irregularity in the range of 1.0 to 2.0. The term "degree of irregularity" as used herein is determined as described below by taking picture at a magnification allowing the observation of 10 or more slit fibers as in the case of the method used in measuring the diameter of the slit fiber (DC) (FIG. 5(*b*)). The diameter of the inscribed circle as used herein is the diameter of a perfect circle which internally contacts with the cross-section in the direction perpendicular to the fiber axis at highest number of points (at two or more points) in the two-dimensional picture that had been taken. The degree of irregularity is the value calculated to the second decimal place by the equation:

$$\text{Degree of irregularity} = (\text{diameter of the circumcircle}) \div (\text{diameter of the inscribed circle})$$

followed by rounding of the resulting value to the first decimal place. This procedure was repeated for the 10 images taken, and simple average of the value for the 10 images was used for the degree of irregularity of the slit fiber. The degree of irregularity as used herein means a degree such that 1.0 corresponds to a perfect circle and increase in the degree corresponds to higher deformation of the cross-section of the fiber.

The spaces or gaps formed between the slit fibers are expected to have the effects of sucking further water by using the already sucked water as the primer by the function of the slit morphology formed in the surface layer of the fiber. In view of this function, the degree of irregularity of the slit fiber is more preferably 1.0 to 1.5, and when the degree of irregularity is in such range, extremely favorable water absorption is realized by the synergetic effects of the gaps between the fibers and the slit morphology formed in the fiber surface layer.

The core-sheath conjugated fiber and the slit fiber preferably has a toughness higher than certain degree in view of the processability in the subsequent process or actual use, and the strength and the elongation of the fiber can be used for the index. The strength as used herein is the value obtained by determining load-elongation curve of the fiber in the conditions described in JIS L1013 (1999) and dividing the load at breakage by the initial fineness, and elongation as used herein is the value obtained by dividing the elongation at break by an initial sample length. The initial fineness is the value by calculating the weight (g) per 10000 m (dtex) from simple average of repetitive measurement of the weight per unit length of the fiber.

The fiber preferably has a strength of 0.5 to 10.0 cN/dtex and an elongation of 5 to 700%. In the fiber, upper limit of the strength for actually carrying out the disclosure is 10.0 cN/dtex, and such upper limit for the elongation is 700%. When the slit fiber is used for inner, outer, and other general garment purpose, the strength is more preferably 1.0 to 4.0 cN/dtex, and the elongation is more preferably 20 to 40%. In a sport gear application used in severer conditions, the strength is more preferably 3.0 to 6.0 cN/dtex, and the elongation is 10 to 40%. When using the fiber for industrial material, for example, wiping cloth or polishing cloth is considered, the fiber will be rubbed against the object being wiped or polished while the fiber is pulled under load. Accordingly, the strength is preferably adjusted to at least 1.0 cN/dtex, and the elongation is preferably adjusted to at least 10% to prevent falling of the fiber during the wiping or the like.

As described above, in the fiber, the strength and the elongation are preferably adjusted by regulating the conditions used in the production steps depending on the intended use and the like.

Next, an example of the method of producing the core-sheath conjugated fiber is described in detail.

The core-sheath conjugated fiber can be produced by using two kinds of polymer and spinning the core-sheath conjugated fiber so that the core component is covered by the sheath component, and the method used to spin the core-sheath conjugated fiber is preferably conjugated spinning by melt spinning in view of improving productivity.

The core-sheath conjugated fiber, of course, can be produced by solution spinning. However, in spinning the core-sheath conjugated fiber, a method using the composite nozzle as described below is preferred in view of the high controllability of the cross-sectional morphology.

Production of the core-sheath conjugated fiber by using conventional known composite nozzle is very difficult in consideration of controlling the cross-sectional morphology of the core component, and in particular, the slit part of the fiber. It may be certainly "in principle" possible to conduct the spinning by using a conventional known nozzle for divided conjugated fiber, but control of the interval between the projections and depth of the slit which are critically important will be difficult. More specifically, in the conventional known composite nozzle technology, the resulting fiber will be the one like the product of the prior art technology wherein the slit extends into the inner layer of the fiber, and realization of the slit fiber having excellent processability in the subsequent process and durability after the sheath dissolution will be difficult.

Figure 6:
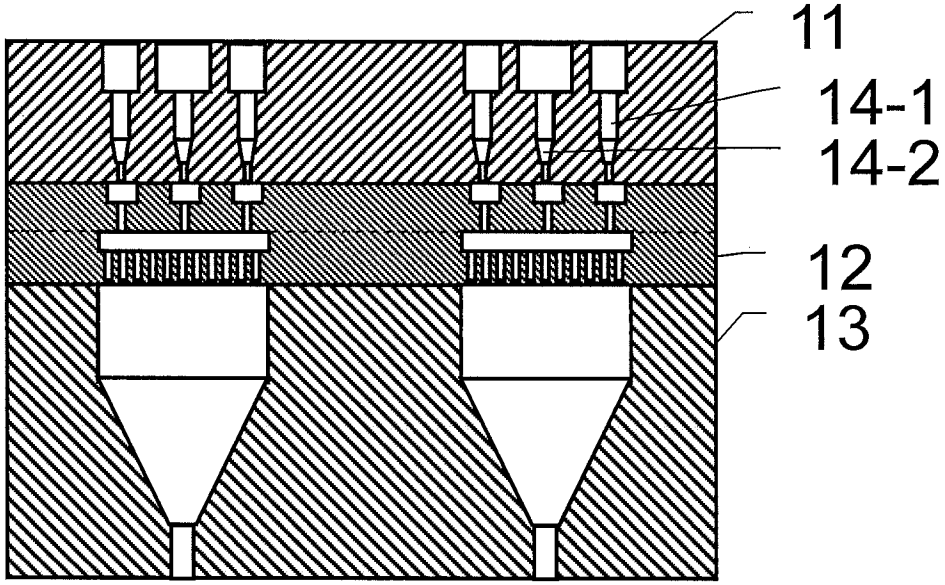
FIG. 6 is a view showing the method of producing the core-sheath conjugated fiber. More specifically, this view is a front cross sectional view of the main part constituting the composite nozzle according to one example of the composite nozzle.

In consideration such situation and to realize the fibers as described above, we found that the method using the composite nozzle as shown in FIG. 6 is preferable.

The composite nozzle shown in FIG. 6 is assembled in the spinning pack for use in the spinning, and the composite nozzle is in the state wherein roughly 3 types of members, namely, a metering plate 11, a distribution plate 12, and a discharge plate 13 are laminated in the order from the top to the bottom. It is to be noted that FIG. 6 is adapted for use of two kinds of polymer, namely, polymer A (core component) and polymer B (sheath component), and FIG. 6 shows an example. In the core-sheath conjugated fiber, the core component may be produced from a hardly soluble component and the sheath component may be produced from an easily soluble component when a slit fiber comprising the polymer A is produced by removing the polymer B by dissolution. The nozzle of FIG. 6 is excellent in controlling the cross-section morphology of the fiber, and more specifically, use of this nozzle in producing the fiber enables production with no limit in the difference of the melt viscosity between the polymer A and the polymer B.

In the nozzle member shown in FIG. 6, the metering plate 11 measures amount of the polymer per discharge hole and amount of the polymer per distribution hole of the core component and the sheath component and the polymer is introduced through the metering plate 11. The distribution plate 12 controls cross-sectional shape of the core component in the cross-section of the single (core-sheath conjugated) fiber. Next, the discharge plate 13 compresses and ejects the conjugated polymer stream formed in the distribution plate 12. While not shown to avoid complicated explanation of the composite nozzle, the members laminated in the upstream of the metering plate may be any member having the flow channel formed therein corresponding to the spinner and the spinning pack. Existing spinning packs and their members can be used with no modification if the metering plate 11 is designed to match existing flow channel members, and in this case, there is no need to prepare a special spinner exclusively for this composite nozzle.

In actual production, a plurality of flow channel plates (not shown) are preferably disposed between the flow channel plate and the metering plate or between the metering plate 11 and the distribution plate 12 to realize a constitution wherein flow channels are provided to efficiently deliver the polymers in the direction of the cross-section of the nozzle and in the direction of the cross-section of the single fiber for introduction into the distribution plate 12. The flow of the conjugated polymer discharged from the discharge plate 13 is cooled for solidification and oiled by the conventional melt spinning method, and then taken up by the roller rotating at the predetermined peripheral speed for production of the core-sheath conjugated fiber.

Next, flow of the polymer from the metering plate 11 and the distribution plate 12 where flows of the conjugated polymer are formed to the discharge from the discharge holes of the discharge plate 13 in the composite nozzle shown in FIG. 6 are sequentially explained from the upstream to the downstream of the composite nozzle.

The polymer A and the polymer B respectively flows from the upstream of the spinning pack into polymer A-metering hole 14-1 and polymer B-metering hole 14-2 of the metering plate, and after being measured by throttling hole provided in each downstream end, flows into the distribution plate 12. Each polymer is then measured by the pressure loss in the throttle equipped at the metering hole. This throttle is designed so that the pressure loss would be at least 0.1 MPa while the throttle is also designed so that the pressure loss would be up to 30.0 MPa to prevent distortion of the member caused by the pressure loss. By the way, this pressure loss is determined by the amount of the polymer entering each metering hole and viscosity of the polymer. For example, when a polymer having a viscosity at a temperature 280° C. and a strain rate of 1000 $s^{-1}$ of 100 to 200 Pa·s is used, and the melt spinning is conducted at a spinning temperature of 280 to 290° C. and amount of discharge per metering hole of 0.1 to 5.0 g/min, the polymer can be discharged with sufficient metering when the throttle of the metering hole has a hole diameter of 0.01 to 1.00 mm and L/D (length of the discharge hole/diameter of the discharge hole) of 0.1 to 5.0. When the polymer has a melt viscosity lower than the viscosity range as described above or the amount discharged from each hole is smaller, the hole diameter may be reduced to the range near the lower limit of such range and/or the hole length may be increased to the range near the higher limit of such range. On the contrary, in a higher viscosity or larger amount of discharge, the hole diameter and the hole length may reversely adjusted.

Preferably, two or more metering plates 11 are laminated to incrementally measure the polymer amount, and the metering holes are preferably provided in 2 to 10 stages. Such division of the metering plate or the metering hole into two or more stages is preferable for the production of the core-sheath conjugated fiber where fine control of the polymer flow on the order of $10^{-5}$ g/min/hole per metering hole is required.

Figure 9:
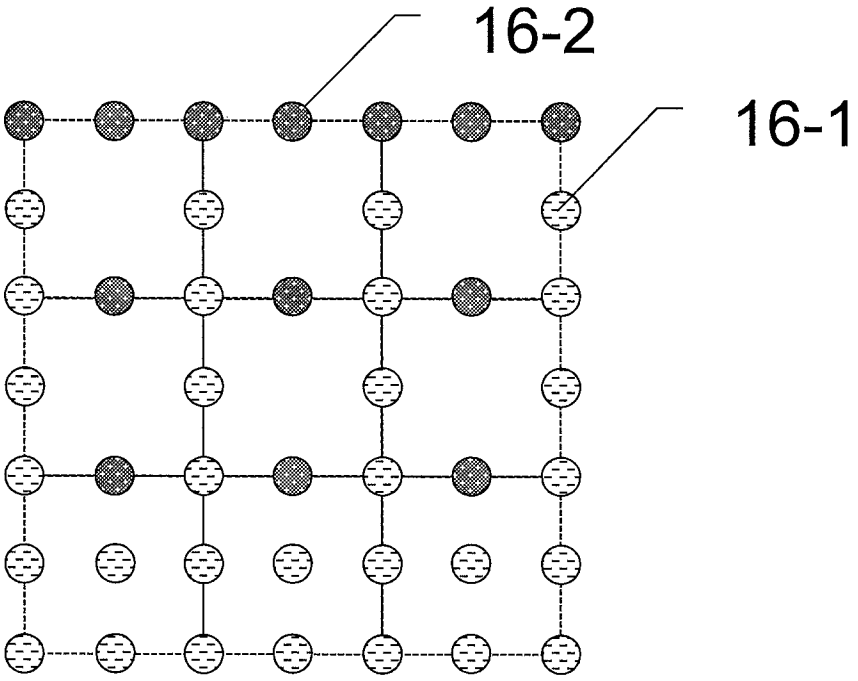
FIG. 9 is a partially enlarged schematic view of an example of the arrangement of the distribution holes in the final distribution plate.

The polymers discharged from each metering hole 14 is respectively introduced in the distribution groove 15 (FIG. 7) of the distribution plate 12. The distribution plate 12 is provided in its interior with distribution grooves 15 for reservation of the polymers introduced from each metering hole 14 and distribution holes 16 (FIG. 7) for guiding the polymer to the downstream on the lower surface of the distribution groove. The distribution groove 15 is preferably provided therethrough with at least 2 distribution holes 16, and the cross-sectional morphology of the conjugated fiber may be controlled by the arrangement of the distribution holes 16 in the final distribution plate immediately above the discharge plate 13. FIG. 9 shows an exemplary arrangement of the distribution holes, and the arrangement of the sheath component distribution holes (16-2 in FIG. 9) between the core component distribution holes (16-1 in FIG. 9) enables arrangement of the sheath component between the core component discharged from the core component distribution holes and formation of the core-and-sheath-type conjugated polymer flow wherein the slit morphology is controlled. In this case, the groove of the slit structure is formed by the sheath component distribution holes, and accordingly, the slit morphology can be controlled to any desired morphology by adjusting the polymer amount and the arrangement of the distribution holes.

The composite nozzle having such mechanism constantly stabilizes the polymer flow as described above, and enables production of a conjugated fiber wherein the cross-section is controlled to a ultra-sophisticated level.

Figure 8:
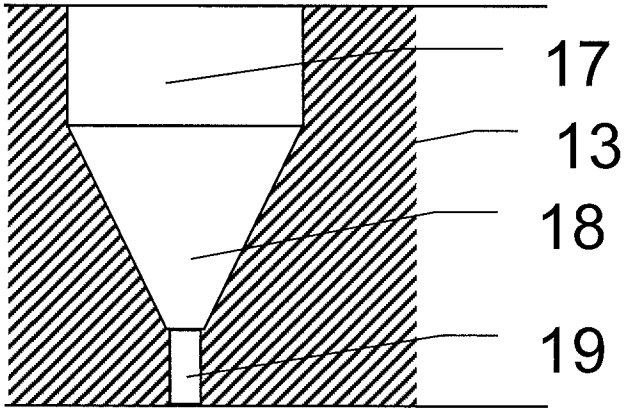
FIG. 8 is a view showing the method of producing the core-sheath conjugated fiber. More specifically, this view is a transverse cross sectional view of a discharge plate.

In view of producing the core-sheath conjugated fiber and also in view of attaining long term stability of the cross-section, melt viscosity ratio ($\eta B/\eta A$) of the melt viscosity $\eta A$ of the core polymer (polymer A) to the melt viscosity $\eta B$ of the sheath polymer (polymer B) is preferably 0.1 to 2.0 in addition to the employment of the new composite nozzle as described above. The term "melt viscosity" is the melt viscosity that can be measured with a capillary rheometer after drying polymer pieces in a vacuum dryer to a water content up to 200 ppm, and more specifically, the melt viscosity at the spinning temperature and at the same shear speed. The morphology of the conjugated cross-section is basically controlled by the arrangement of the distribution holes. However, change with lapse of time including the change in viscosity of the polymer by moisture absorption should be taken into account in the planning of long-term production since the conjugated polymer flow undergoes thinning in the cross-sectional direction by the thinning hole 18 (FIG. 8) after formation of the conjugated polymer flow by the joining of the polymers, and effects caused by such change can be reduced to enable stable production when the melt viscosity ratio is within the range as described above. In such point of view, the more preferable range is $\eta B/\eta A$ of 0.1 to 1.0. It is to be noted that the melt viscosity of the polymer as described above can be relatively freely controlled by adjusting the molecular weight and the component copolymerized even for the polymer of the same type, and therefore, the melt viscosity is used for the index of the polymer combination or settings of the spinning conditions.

The conjugated polymer flow discharged from the distribution plate 12 enters the discharge plate 13, which is preferably provided with discharge-introductory hole 17. The discharge-introductory hole 17 is a hole for guiding the conjugated polymer flow discharged from the distribution plate 12 for a predetermined distance in the direction perpendicular to the discharge plane. In other words, the discharge-introductory hole 17 is provided for the purpose of ameliorating the difference in the flow rate between the polymer A and the polymer B and reducing the flow rate distribution in the cross-sectional direction of the conjugated polymer flow. Control of the slit morphology in the outermost layer of the core component is the most critical issue, and provision of this discharge-introductory hole 17 is preferable for amelioration of the polymer flow rate of the outermost layer which is relatively susceptible to distortion in the compression of the conjugated polymer flow. Although consideration of the molecular weight of the polymer is necessary, the discharge-introductory hole 17 is preferably designed so that the time before introduction of the conjugated polymer flow into the thinning hole 18 would be $10^{-1}$ to 10 seconds (=length of the discharge-introductory hole/polymer flow speed) in view of substantially completing the amelioration of the flow rate ratio. When the time is in such range, the flow rate distribution is sufficiently mitigated, and this contributes to the improvement of the cross-section stability.

Figure 7:
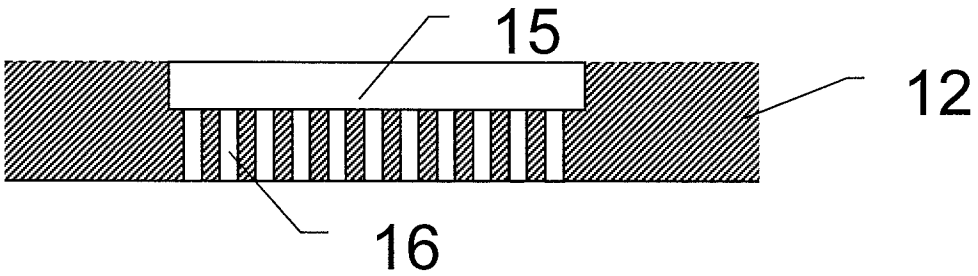
FIG. 7 is a view showing the method of producing the core-sheath conjugated fiber. More specifically, this view is a transverse cross sectional view of a part of a distribution plate.

The conjugated polymer flow is discharged from the discharge hole 19 (FIG. 8) to the spinning line via the discharge-introductory hole 17 and the thinning hole 18 while retaining the cross-section the same as the arrangement of the distribution hole 16 (FIG. 7). This discharge hole 19 is provided for the purpose of re-measuring the flow rate of the conjugated polymer flow, namely, amount of the discharge, and the purpose of controlling the drafting on the spinning line (=take up speed/discharge line speed). The diameter and length of the discharge hole 19 is preferably determined by considering the polymer viscosity and the amount discharged. In producing the core-sheath conjugated fiber, the discharge hole diameter D is preferably 0.1 to 2.0 mm, and L/D (discharge hole length/discharge hole diameter) is preferably selected from the range of 0.1 to 5.0.

When the melt spinning is selected, the island component and the sea component may be prepared from a polymer which can be molded by melting, and exemplary such polymers include polyethylene terephthalate, polyethylene naphthalate, polybuthylene terephthalate, polytrimethylene terephthalate, polypropylene, polyolefin, polycarbonate, polyacrylate, polyamide, polylactic acid, thermoplastic polyurethane, and polyphenylene sulfide and copolymers thereof. More specifically, the polymer may have a melting point of at least 165° C. in view of the improved heat resistance. The polymer may also contain an inorganic substance such as titanium oxide, silica, or barium oxide, a colorant such as carbon black, dye, or pigment, or other additives such as flame retardant, fluorescent brightener, antioxidant, or UV absorbent.

A preferable combination of the polymers for spinning the core-sheath conjugated fiber include use of polyethylene terephthalate, polyethylene naphthalate, polybuthylene terephthalate, polytrimethylene terephthalate, polyamide, polylactic acid, thermoplastic polyurethane, and polyphenylene sulfide by changing the molecular weight for the polymer A and the polymer B, or using a homopolymer for one polymer and using a copolymerized polymer for the other polymer in view of suppressing peeling. In view of improving bulkiness by the spiral structure, a combination having different polymer composition is preferable, and exemplary combinations (polymer A/polymer B) include polyethylene terephthalate/polybuthylene terephthalate, polyethylene terephthalate/polytrimethylene terephthalate, polyethylene terephthalate/thermoplastic polyurethane, and polybuthylene terephthalate/polytrimethylene terephthalate.

The spinning temperature is preferably a temperature at which the polymer having a higher melting point or a higher viscosity exhibits flowability of the polymers whose use has been determined in view of the situation as described above. While this temperature at which flowability is exhibited differs by the properties and molecular weight of the polymer, melting point of the polymer can be used as an index, and the temperature can be set at a temperature not higher than the melting point plus 60° C. When the temperature is not higher than the melting point plus 60° C., the polymer will not be thermally degraded in the spinning head or spinning pack, and hence, decrease in the molecular weight is suppressed to enable favorable production of the core-sheath conjugated fiber.

Typical amount of the polymer discharge is 0.1 g/min/hole to 20.0 g/min/hole per discharge hole which is an amount capable of conducting the melt discharge without sacrificing the stability. With regard to this amount, pressure loss in the discharge hole is preferably considered to thereby enable stable discharge. The amount of the polymer discharge is preferably determined within the range as described above in relation to the melt viscosity of the polymer, the discharge hole diameter, and the discharge hole length by considering the pressure loss of 0.1 MPa to 40 MPa as a rough estimate.

The ratio of the core component (polymer A) to the sheath component (polymer B) in the spinning of the core-sheath conjugated fiber may be selected from the range of 50/50 to 90/10 in the core/sheath ratio in weight ratio on the basis of the amount discharged. Of such core/sheath ratio, increase in the core ratio is preferable in view of the productivity of the slit fiber. However, the core/sheath ratio is more preferably in the range of 70/30 to 90/10 for the long term stability of the core-sheath conjugated cross section and well balanced and efficient production of the slit fiber while retaining the stability. In consideration of quick completion of the dissolution treatment, the core/sheath ratio is most preferably 80/20 to 90/10.

The yarn melt-discharged from the discharge hole is cooled for solidification, bundled by applying an oiling agent, and taken up by a roller at the predetermined peripheral speed. This take up speed is determined by the discharged amount and intended fiber diameter, and the take up speed is preferably in the range of 100 m/min to 7000 m/min in view of stably producing the core-sheath conjugated fiber. The thus spun core-sheath conjugated fiber is preferably stretched in view of improving thermal stability and mechanical properties. This stretching may be conducted either after taking up the core-sheath conjugated fiber or subsequent to the spinning without taking up.

With regard to the conditions used in the stretching, a fiber comprising a polymer normally exhibiting melt-spinnable thermoplasticity may be stretched, for example, in a stretcher comprising at least one pair of rollers by the ratio of the peripheral speed of the first roller adjusted to the temperature of at least glass transition temperature and up to melting point to the peripheral speed of the second roller adjusted to a temperature corresponding to the crystallization temperature. The fiber is smoothly stretched in this process in the direction of the fiber axis, thermally set, and taken up. In the polymer not exhibiting glass transition, dynamic viscoelasticity (tan δ) of the conjugated fiber may be measured, and a temperature higher than the temperature of the higher peak of the thus obtained tan δ may be chosen for the preliminary heating temperature. In this process, the stretching may be conducted in two or more stages to improve stretching ratio and improving the mechanical properties.

When the slit fiber is generated from the core-sheath conjugated fiber, the conjugated fiber is immersed in a solvent which can dissolve the easily soluble component to remove the sheath component. When the easily soluble component is a copolymerized polyethylene terephthalate or polylactic acid having 5-sodium sulfoisophthalic acid, polyethylene glycol or the like copolymerized therewith, the solvent used may be an alkaline aqueous solution such as aqueous solution of sodium hydroxide. An exemplary method of treating the conjugated fiber with an alkaline aqueous solution is immersion of a conjugated fiber or a fiber structure produced therefrom in an alkaline aqueous solution. The alkaline aqueous solution is preferably heated to a temperature of at least 50° C. since hydrolysis can be accelerated at such temperature. Use of a fluid dyeing machine or the like is also preferable in commercial point of view since a large amount can be treated at once, and productivity is thereby improved.

The method of producing the core-sheath conjugated fiber and the slit fiber have been described for the melt spinning aiming at the production of a long fiber. The core-sheath conjugated fiber and the slit fiber, however, can also be produced by melt blowing or spun bonding adapted for production of sheet products, or alternatively, by a wet or dry solution spinning.

EXAMPLES

Next, the core-sheath conjugated fiber and the slit fiber are described in detail by referring to the Examples.

The Examples and the Comparative Examples were evaluated by the procedure as described below.

A. Melt Viscosity of the Polymer

After drying polymer pieces to a water content of up to 200 ppm by using a vacuum dryer, the melt viscosity was measured by incrementally changing the strain rate by using CAPILOGRAPH 1B manufactured by Toyo Seiki Seisakusho, Ltd. The measurement was conducted at the temperature the same as the temperature used for the spinning, and in the Examples and the Comparative Examples, the melt viscosity described is the one measured at 1216 $s^{-1}$. The time interval between the introduction of the sample into the heating furnace and the start of the measurement was 5 minutes, and the measurement was conducted in nitrogen atmosphere.

B. Fineness

The core-sheath conjugated fiber and the slit fiber collected were weighed for their weight per unit length in an atmosphere at a temperature of 25° C. and relative humidity of 55%, and the weight corresponding to 10000 m is calculated. This procedure was repeated 10 times, and the simple average rounded off from the first decimal place was used for the fineness.

C. Mechanical Properties of the Fiber

Stress-strain curve of the core-sheath conjugated fibers and the slit fibers was measured by using a tensile tester Tensilon model UCT-100 manufactured by ORIENTEC CORPORATION under the conditions including the sample length of 20 cm and the tensile speed of 100%/min. The load at breakage is read, and this load is divided by the initial fineness to calculate the strength. The strain at breakage is also read, and this value is divided by the sample length and multiplied by 100 to calculate the elongation at breakage. Both values are the values obtained by repeating the procedure as described above for 5 times, calculating the simple average, and rounding the value from the second decimal place in the case of the strength and from the first decimal place in the case of the elongation.

D. Cross-Sectional Parameters of the Core-Sheath Conjugated Fiber

The core-sheath conjugated fiber was embedded in epoxy resin, frozen by FC-4E Cryosectioning System manufactured by Reichert, and sliced with Reichert-Nissei ultracut N (ultramicrotome) equipped with a diamond knife, and the sliced surface was observed at the magnification capable of observing at least 10 core-sheath conjugated fibers by using scanning electron microscope (SEM) VE-7800 manufactured by KEYENCE. From this image, 10 core-sheath conjugated fibers were randomly chosen, and the diameter (DA) of the circumcircle of the core component projection was measured by using an image processing software (WINROOF). In addition, for the projection of each core component of the core-sheath conjugated fiber, distance between the projections (PA), tip width of the projection (WA), projection height (H), and bottom width of the projection (WB) for 10 positions were measured. This procedure was repeated for 10 images, and the average of the 10 images was used for each value. It should be noted that these values were determined to the second decimal place in μm unit, and rounded to the first decimal place.

E. Evaluation of Loss in the Dissolution Treatment of the Sheath Component

Knitted fabrics of the core-sheath conjugated fibers obtained in various spinning conditions were placed in a dissolution bath filled with a solvent capable of dissolving the sheath component (bath ratio, 100) to remove at least 99% of the sheath component.

The evaluation as described below was conducted to confirm loss of the slit.

100 ml of the solvent used for the dissolution was collected, and this solvent was passed through a glass fiber filter (retention particle size, 0.5 μm). The loss of the slit (projection) was confirmed from the difference in the dry weight of the filter before and after the treatment. The loss was evaluated "C" (large loss) when the weight difference was 10 mg or more, "B" (modest loss) when the weight difference was less than 10 mg and at least 5 mg, and "A" (no loss) when the weight difference was less than 5 mg.

F. Fiber Diameter of the Slit Fiber

The slit fibers obtained from the core-sheath conjugated fiber by dissolving at least 99% of the sheath component were embedded in epoxy resin by the same procedure as the core-sheath conjugated fiber, and after slicing, the sliced surface was observed at a magnification allowing the observation of least 10 slits by a microscope VHX-2000 manufactured by KEYENCE. 10 slit fibers were randomly chosen from this image, and fiber diameter (DC) was measured by using the image processing software (WINROOF) to the second decimal place in μm unit. After repeating this procedure for 10 images, simple number average was calculated rounded to the first decimal place.

G. Slit Width and Variation of the Slit Width (CV %)

The slit fiber was adhered in transverse direction on the observation stage, and a picture was taken at a magnification allowing the observation of least 10 slits formed in the fiber surface area by a scanning electron microscope (SEM) model VE-7800 manufactured by KEYENCE. 10 slits were randomly chosen from this image to determine the slit width by using the image processing software (WINROOF). It is to be noted that the slit width was determined to the second decimal place in the μm unit and rounded to the first decimal place. This procedure was repeated for 10 images, and the average and the standard deviation of the 10 images were determined. The variation (CV %) of the slit width was calculated from these results by the following equation:

$$\text{Variation of the slit width } (CV\,\%) = (\text{standard deviation}/\text{average}) \times 100$$

The variation of the slit width was calculated to the second decimal place, and rounded to the first decimal place.

H. Evaluation of Abrasion Resistance of the Slit Fiber 10 fabric samples each having a diameter of 10 cm were prepared, and a set of 2 fabric samples were respectively placed on evaluation holders. After completely wetting one sample with distilled water and placing the 2 samples one on another and abrading the samples by pressing at a pressure of 7.4 N, fibrillation of the monofibers was observed by using a microscope VHX-2000 manufactured by KEYENCE at a magnification of 50. In this process, change in the sample surface before and after the abrasive treatment was confirmed to evaluate the fibrillation in 3 grades. The abrasion resistance was evaluated "C" (fail) when the fibrillation occurred over the entire sample surface in the treatment, "B" (pass) when the fibrillation occurred in some parts of the sample surface, and "A" (good) when no fibrillation was confirmed.

I. Water Absorption Performance 10 fabric samples each having a width of 1 cm were prepared, and the lower end (about 2 cm) of each sample was immersed in distilled water. The height of the water absorption after 10 minutes was evaluated according to JIS L1907 "Testing methods for water absorbency of textiles" (2010). The water absorption height was determined to the first decimal place in mm unit, and rounded off from first decimal place. The average was calculated for use as the water absorption performance.

J. Water Repellency Performance 10 samples for use in the evaluation with a size of 20 cm×20 cm were cut out from the sample fabric which had been subjected to water repellency treatment with a hydrocarbon water repellent. A circle with a diameter of 11.2 cm was depicted in the center of each sample, and the sample was stretched so that the area of the sample was enlarged by 80%, and after securing the sample in the test piece holder used in the water repellency test (JIS L 1092), the spray test (JIS L 1092 (2009)) was conducted for grade determination. The water repellency performance was evaluated in 5 grades, and the average of the evaluation for the 10 samples was used for the water repellency performance.

K. Dissolution Speed Ratio (Sheath/Core)

Pieces of the polymer used for the core component and the sheath component were treated for 5 hours in a hot air oven adjusted to 110° C., and 10 g of the polymer was immersed in 1% by weight aqueous solution of sodium hydroxide (bath ratio, 20) which had been heated to 90° C. to measure the amount of dissolution in relation to the time of the treatment as the difference between the initial weight and the weight after the dissolution treatment. Average amount of the dissolution per unit time was calculated from the measurements for 1 minute, 5 minutes, and 10 minutes of dissolution to thereby evaluate the dissolution speed of each polymer. The thus obtained dissolution speed of the sheath polymer was divided by the dissolution speed of the core polymer, and the result was rounded off from the first decimal place for use as the dissolution speed ratio.

Example 1

Polyethylene terephthalate (PET1 melt viscosity, 140 Pa·s) was used for the core component, and a copolymerized polyethylene terephthalate (copolymerized PET 1 having a melt viscosity of 45 Pa·s) prepared by copolymerizing 8.0% by mole of 5-sodium sulfoisophthalic acid and 10 wt % of polyethylene glycol having a molecular weight of 1000 was used for the sheath component. These polymers were respectively melted at 290° C., weighed, and introduced in a spinning pack having the composite nozzle shown in FIG. 6 assembled therein, and a flow of composite polymer was discharged from the discharge hole. The distribution plate immediately above the discharge plate was the one wherein the part at the interface between the core component and the sheath component had the arrangement of the pattern shown in FIG. 9, where the group of distribution holes for the core component and the group of distribution holes for the sheath component were alternately arranged so that 24 slits were formed in the core-sheath conjugated fiber. The discharge plate used was the one having the length of the discharge-introductory hole of 5 mm, the angle of the thinning hole of 60°, a discharge hole diameter of 0.3 mm, and a discharge hole length/discharge hole diameter of 1.5.

coreTotal discharge amount of the polymer was 31.5 g/min, and the core sheath conjugation ratio was adjusted to 80/20 on weight ratio basis. The molten discharged yarn was cooled for solidification, oiled with an oil agent, and wound at a spinning rate of 1500 m/min to obtain unstretched fiber. The unstretched fiber was then stretched between the rollers that has been heated to 90° C. and 130° C., respectively, to 3.0 times the original length (stretching speed, 800 m/min) to thereby produce a core-sheath conjugated fiber (70 dtex—36 filaments).

With regard to the projections of the core component, the height (H), the tip width (WA), and the bottom width (WB) were respectively 1.3 μm, 0.8 μm, and 1.2 μm, the $H/(WA)^{1/2}$ was 1.5, and the WB/WA was 1.5 to thereby confirm that the fiber was the core-sheath conjugated fiber.

The core-sheath conjugated fiber obtained in Example 1 had mechanical properties including the strength of 3.4 cN/dtex and the elongation of 28%, which were sufficient to conduct the subsequent process, and no yarn breakage or the like occurred in the subsequent processing into woven or knitted products.

A knitted test piece was prepared by using the core-sheath conjugated fiber of Example 1, and at least 99% of the sheath component of this test piece was removed by immersing the knitted test piece in 1% by weight aqueous solution of sodium hydroxide that had been heated to 90° C. (bath ratio, 1:100). In this process, the sheath component was rapidly dissolved within 10 minutes from the start of the dissolution treatment, and loss of the slit projection was not recognized in visual inspection of the solvent used for the dissolution of the sheath component. Evaluation of the loss of the projection was conducted by using this solvent having the sheath component dissolved therein, and the evaluation result was "no loss (A)" when the weight change of the filter paper was less than 3 mg, and in this case, the fiber exhibited excellent processability in the subsequent process with no deterioration of the slits. The slit loss was not recognized even when the fiber was further treated for another 10 minutes with the alkaline aqueous solution that had been heated to 90° C.

The slit fiber collected by the procedure as described above had projection morphology such that the projections and the grooves were alternately present in the cross-section in the direction perpendicular to the fiber axis, and the height of the projection (HT), the tip width of the projection (WAT), and the bottom width of the projection (WBT) were those within the scope as shown in Table 1. The variation of the slit width was 5.3%, and the self-standing of the slits with the slit width of 0.9 μm could be recognized in all the examined images. Next, abrasion resistance was evaluated, and in the evaluation, slit peeling and fibrillation were not recognized on the sample surface even when the test piece was compulsorily abraded because of the slit morphology with the excellent abrasion resistance derived from the core-sheath conjugated fiber (Evaluation of the abrasion resistance: good (A)).

When this slit fiber exhibiting excellent durability was evaluated for its water absorption performance without conducting the water repellency treatment, the slit fiber exhibited excellent water absorption performance (water absorption height, 132 mm). In the meanwhile, when the fiber (56 dtex—24 filament) solely comprising the PET having round cross-section was evaluated by the same method, the water absorption height was 32 mm, and this means that the slit fiber obtained in Example 1 had a water absorption performance at least 4 times that of the conventional fiber having the round cross-section. As a unique feature, when the slit fiber is subjected to water repellent treatment, the static contact angle of the water exceeds 130° and grade of the dynamic water repellency performance critical in actual use was evaluated to be grade 5.0 on average, proving the good water repellency performance. The results are shown in Table 1.

Examples 2 and 3

The procedure of Example 1 was repeated except that the core/sheath ratio was changed to 70/30 (Example 2) and 90/10 (Example 3).

In Example 2, the core ratio was reduced and this resulted in the deeper slits compared to Example 1. However, both projection loss and abrasion resistance were favorable due to the sufficient width of the projection. Water absorbency was improved because of the deeper slit.

In Example 3, the projection width increased due to the increase in the core ratio, and the fiber exhibited excellent durability compared to Example 1. It is to be notated that, in Example 3, the water absorbency and the like decreased with the decrease in the slit depth compared to Example 1. However, the water absorption height was 3.6 times that of the conventional fiber having circular cross-section, and the water absorption performance was sufficient. The results are shown in Table 1.

Examples 4 and 5

The procedure of Example 1 was repeated except that the core/sheath ratio was fixed at 80/20, and slit number of the core component was changed to 10 (Example 4) and 50 (Example 5).

In both Examples, the core component had stable structure with the desired projections, and the fibers satisfied our requirements. In Example 5, the projection height reduced with the decrease in the width of the projection as a result of increase in the number of the slits, and the dissolution step could be conducted with no problem since slit loss did not occur in the dissolution step. However, some fibrils were observed in the evaluation of the abrasion resistance, while the fibrils had no problem in actual use. The results are shown in Table 1.

TABLE 1

| | | | Example 1 | Example 2 | Example 3 | Example 4 | Example 5 |
|---|---|---|---|---|---|---|---|
| Polymer | Core | — | PET1 | PET1 | PET1 | PET1 | PET1 |
| | Sheath | — | Copolymerized PET1 | Copolymerized PET1 | Copolymerized PET1 | Copolymerized PET1 | Copolymerized PET1 |
| | Dissolution speed ratio | — | 2000 | 2000 | 2000 | 2000 | 2000 |
| Core/Sheath | Core | % | 80 | 70 | 90 | 80 | 80 |
| area ratio | Sheath | % | 20 | 30 | 10 | 20 | 20 |
| Nozzle | Slit number | — | 24 | 24 | 24 | 10 | 50 |
| Core-sheath | Total fineness | dtex | 70 | 70 | 70 | 70 | 70 |

TABLE 1-continued

| | | | Example 1 | Example 2 | Example 3 | Example 4 | Example 5 |
|---|---|---|---|---|---|---|---|
| conjugated fiber | Filament number | — | 36 | 36 | 36 | 36 | 36 |
| | Strength | cN/dtex | 3.4 | 2.9 | 4.1 | 3.4 | 3.4 |
| | Elongation | % | 28 | 25 | 32 | 28 | 28 |
| | Projection height (H) | μm | 1.3 | 1.6 | 1.1 | 2.0 | 0.9 |
| | $H/(WA)^{1/2}$ | — | 1.5 | 2.1 | 1.0 | 1.2 | 2.1 |
| | WB/WA | — | 1.5 | 1.5 | 1.2 | 0.8 | 3.0 |
| | WA/PA | — | 0.5 | 0.3 | 0.6 | 0.7 | 0.2 |
| | DA/PA | — | 7.3 | 7.3 | 7.3 | 2.9 | 15.6 |
| | Evaluation of loss | — | A | A | A | A | A |
| Slit fiber | Fineness | dtex | 56 | 49 | 63 | 56 | 56 |
| | Strength | cN/dtex | 2.7 | 2.0 | 3.6 | 2.6 | 2.9 |
| | Elongation | % | 41 | 38 | 42 | 34 | 43 |
| | Fiber diameter (DC) | μm | 12.8 | 12.5 | 13.0 | 12.8 | 12.8 |
| | Projection height (HT) | μm | 1.2 | 1.5 | 1.0 | 1.9 | 0.9 |
| | $HT/(WAT)^{1/2}$ | — | 1.5 | 2.2 | 1.1 | 1.2 | 2.2 |
| | WBT/WAT | — | 1.5 | 1.6 | 1.3 | 0.8 | 3.0 |
| | Slit width (WC) | μm | 0.9 | 1.1 | 0.6 | 1.4 | 0.6 |
| | Variation of the slit width | % | 5.3 | 8.3 | 4.8 | 4.3 | 9.8 |
| | Degree of irregularity | — | 1.1 | 1.5 | 1 | 1 | 1.5 |
| | Evaluation of abrasion resistance | — | A | A | A | A | B |
| | Water absorption performance | mm | 132 | 141 | 117 | 121 | 148 |
| | Water repellency performance | — | 5.0 | 5.0 | 4.3 | 5.0 | 4.3 |
| Note | | | | | | | |

Comparative Example 1

The PET1 and the copolymerized PET1 used in Example 1 were used for the core component and the sheath component. The spinning was conducted by using the conventional spinning nozzle described in Japanese Unexamined Patent Publication (Kokai) No. 2008-7902 wherein fine holes corresponding to the number of the core component projections were provided at the interface between the core component and the sheath component, and the slits were formed by the grooves which are provided for introduction of the sheath component between the fine holes for core component so that the sheath component flows from the fiber center to the periphery. In this process, the fine holes of the core component and the grooves for the sheath component were alternately provided so that the slits were formed at 200 positions. Other conditions were those used in Example 1.

In the cross-section of the core-sheath conjugated fiber collected in Comparative Example 1, control of the slit morphology was difficult since the sheath component was introduced, in principle, in the cross-sectional direction of the fiber by using a groove so that the projections of the core component were covered with the sheath component. As a consequence, height of the projections was uneven and some projections extended into the inner layer of the fiber (diameter of the circumcircle of the core component, 15.8 μm; average projection height, 3.3 μm). In addition, width of the projection was as thin as 0.2 μm and the bottom of the projection was even thinner (WB/WA: 0.8) due to the provision of the large number of the slits. When the removal by dissolution of the sheath component from the core-sheath conjugated fiber was conducted by the procedure described in Example 1, since the sheath component provided in the groove part was very thin, the solvent took very long time to reach the inner layer of the fiber, and when the time required for complete dissolution was examined in terms of weight loss by measuring change in the weight, 40 minutes, namely, at least 4 times that of Example 1 was necessary. In Comparative Example 1, the projections were deteriorated during the dissolution treatment by the exposure to the heated alkaline aqueous solution for a long time, and many projections became peeled off by the abrasion with other fibers and the like since the width of the projections were very thin (evaluation of the projection loss: many falling (C)). When the dissolution treatment was continued in consideration of the situation that the loss in terms of weight continued in the dissolution treatment of 40 minutes or more, increase in the projection loss could be visually confirmed, and the decrease of the sample weight continued to 60 minutes (weight loss, 47%).

The slit fiber produced in Comparative Example 1 had slits extending into the inner layer, and durability of the slit fiber in the compression direction was low, and the entire slit fiber was distorted (degree of irregularity: 2.6). When the side surface of the fiber was observed to evaluate the slit width, the projections were not self-standing, and the slit width were uneven depending on the place chosen for the observation due to the waviness of the slits (variation of the slit width: 28%). When the abrasion resistance test was subsequently conducted, the fibrils on the sample surface clearly increased compared to the state before the abrasion treatment, and the texture after the abrasion treatment was also rough (abrasion resistance: fail (C)). The results are shown in Table 2.

Comparative Example 2

In consideration of the results of the Comparative Example 1, the procedure of Comparative Example 1 was repeated except that the spinning was conducted by retaining the core/sheath ratio of 80/20 while increasing the total discharge amount to thereby increase the width of the projection.

While the width of the projection could be increased to some extent by increasing the total discharge amount, the increase in the total discharge amount invited increase in the slit depth and the resulting fiber failed to satisfy our requirements. In other words, the increase in the total discharge amount did not improve abrasion resistance of the slit fiber despite some merits in suppressing the projection loss. In addition, this deterioration of the slit invited the failure in exhibiting the water repellency despite the water repellent treatment. The results are shown in Table 2.

Comparative Example 3

The procedure of Comparative Example 1 was repeated except that the slit number was reduced to 8 in addition to the increase of the total discharge amount to thereby increase the width of the projection as in the case of Comparative Example 2.

While remarkable increase in the width of the projection was realized by reducing the slit number, control of the slit morphology was difficult due to the use of the spinning nozzle having the groove to introduce the sheath component into the fiber inner layer are provided therethrough, deep groove comparable to Comparative Example 2 were formed. In the observation of the slit morphology, the grooves were wider in the inner layer and the projection had thinner bottom, and the core-sheath conjugated fiber did not satisfy our requirements (WB/WA: 0.5).

When the core-sheath conjugated fiber obtained in Comparative Example 3 was subjected to dissolution treatment, the projections could not endure the deformation experienced in the dissolution treatment, and the projection loss occurred at a degree equal or higher than Comparative Example 2 (Evaluation of the projection loss: Medium falling(B)).

Since the slit after the dissolution had an increased slit width with the slit widening toward the inner layer, the projections were easily peeled when abraded, and many fibrils were present on the sample surface. In addition, due to the wide slit width, the fiber did not exhibit our unique water-related effects, and both water absorption and water repellency were far inferior compared to our slit fibers. It is to be noted that the water-related properties are dependent on the presence of the slits, and the slit degradation by the dissolution treatment should be a reason for the degradation of the function. The results are shown in Table 2.

Example 6

Nylon 6 (N6 with a melt viscosity of 120 Pa·s) used for the core component and the copolymerized PET1 (with a melt viscosity of 55 Pa·s) used in Example 1 for the sheath component were separately melted at 270° C., weighed, and discharged from 24 holes at a total discharge amount of 50 g/min and a core/sheath ratio of 80/20 so that 50 slits were formed in one core-sheath conjugated fiber by using the distribution hole arrangement pattern shown in FIG. 9. All other conditions were as in Example 1.

The core-sheath conjugated fiber of Example 6 had the desired cross-section where projections each having a width of 0.3 μm and a height of 1.5 μm were formed at 24 positions, and the projection had a shape widening from the tip to the bottom (WB/WA: 3.0). $H/(WA)^{1/2}$ which indicates rigidity of the projection was 2.7, satisfying the requirement. While the slit was slightly deep (1.5 μm), the projection had a shape durable to exterior force. Accordingly, this core-sheath conjugated fiber exhibited no projection loss in the dissolution treatment of the sheath component, the abrasion resistance after the sheath dissolution was also excellent.

The slit fiber after the dissolution had slits having a width of 1.1 μm in the fiber surface layer at an even interval, and the fiber exhibited excellent water absorption and water repellency. The results are shown in Table 3.

Example 7

The procedure of Example 6 was repeated except that the spinning was conducted by changing the core component to polybuthylene terephthalate (PBT melt viscosity: 160 Pa·s).

TABLE 2

| | | | Comparative Example 1 | Comparative Example 2 | Comparative Example 3 |
|---|---|---|---|---|---|
| Polymer | Core | — | PET1 | PET1 | PET1 |
| | Sheath | — | Copolymerized PET1 | Copolymerized PET1 | Copolymerized PET1 |
| | Dissolution speed ratio | — | 2000 | 2000 | 2000 |
| Core/Sheath area ratio | Core | % | 80 | 80 | 80 |
| | Sheath | % | 20 | 20 | 20 |
| Nozzle | Slit number | — | 200 | 200 | 8 |
| Core-sheath conjugated fiber | Total fineness | dtex | 70 | 111 | 111 |
| | Filament number | — | 24 | 24 | 24 |
| | Strength | cN/dtex | 2.8 | 3.1 | 3.6 |
| | Elongation | % | 33 | 27 | 25 |
| | Projection height (H) | μm | 3.3 | 4.2 | 4.4 |
| | $H/(WA)^{1/2}$ | — | 8.5 | 9.1 | 1.6 |
| | WB/WA | — | 0.8 | 0.8 | 0.5 |
| | WA/PA | — | 0.6 | 0.7 | 0.9 |
| | DA/PA | — | 63.4 | 63.4 | 2.2 |
| | Evaluation of loss | — | C | B | B |
| Slit fiber | Fineness | dtex | 56 | 89 | 89 |
| | Strength | cN/dtex | 2.2 | 2.4 | 2.8 |
| | Elongation | % | 48 | 40 | 37 |
| | Fiber diameter (DC) | μm | 15.7 | 19.7 | 19.7 |
| | Projection height (HT) | μm | 3.1 | 4.0 | 4.2 |
| | $HT/(WAT)^{1/2}$ | — | 9.0 | 9.5 | 1.6 |
| | WBT/WAT | — | 0.9 | 0.8 | 0.5 |
| | Slit width (WC) | μm | 0.1 | 0.1 | 1.0 |
| | Variation of the slit width | % | 28 | 21 | 13.1 |
| | Degree of irregularity | — | 2.6 | 2.2 | 2.1 |
| | Evaluation of abrasion resistance | — | C | C | C |
| | Water absorption performance | mm | 93 | 101 | 63 |
| | Water repellency performance | — | 3.2 | 2.9 | 3.5 |
| Note | | | | | |

The core-sheath conjugated fiber and the slit fiber obtained in Example 7 also had durability and excellent properties as in the case of Example 7. The results are shown in Table 3.

Example 8

The procedure of Example 6 was repeated except that the spinning was conducted by changing the core component to polypropylene (PP melt viscosity: 150 Pa·s).

The core-sheath conjugated fiber and the slit fiber obtained in Example 8 also had excellent durability as in the case of Example 6. In Example 8, the slit fiber was formed from PP which exhibits hydrophobicity, and it was confirmed this fiber has good dynamic water repellency without any water repellent treatment despite the difficulty of exhibiting the water absorption performance. PP has a light weight with a density of 0.91 g/cm$^3$, and this fiber should be well adapted for a wide variety of textiles for comfort garments such as inner and outer garment. The results are shown in Table 3.

Example 9

The procedure of Example 6 was repeated except that the core component was polyphenylene sulfide (PPS melt viscosity: 170 Pa·s), the sheath component was polyethylene terephthalate having 5.0% by mole of 5-sodium sulfoisophthalic acid copolymerized therewith (copolymerized PET2; melt viscosity 110 Pa·s), and the spinning was conducted at a spinning temperature of 300° C.

The core-sheath conjugated fiber of Example 9 also had the projection morphology satisfying our requirements and, accordingly, it had no problem in processability in the subsequent process or the durability. Although PPS used in Example 9 is known to be a hydrophobic polymer which is a polymer having low affinity with water, we found that a fiber having a high wettability with the water absorption height as high as 118 mm is produced when the fiber produced is the slit fiber. Since PPS is a polymer with high chemical resistance and current usage of this polymer include use in a liquid as in the case of battery separator and liquid filter, use of our slit fiber is likely to allow use of the PPS in such applications.

The results are shown in Table 3.

TABLE 3

| | | | Example 6 | Example 7 | Example 8 | Example 9 |
|---|---|---|---|---|---|---|
| Polymer | Core | — | N6 | PBT | PP | PPS |
| | Sheath | — | Copolymerized PET1 | Copolymerized PET1 | Copolymerized PET1 | Copolymerized PET2 |
| | Dissolution speed ratio | — | 30000 or higher | 12000 | 30000 or higher | 30000 or higher |
| Core/Sheath area ratio | Core | % | 80 | 80 | 80 | 80 |
| | Sheath | % | 20 | 20 | 20 | 20 |
| Nozzle | Slit number | — | 50 | 50 | 50 | 50 |
| Core-sheath conjugated fiber | Total fineness | dtex | 112 | 112 | 112 | 112 |
| | Filament number | — | 24 | 24 | 24 | 24 |
| | Strength | cN/dtex | 4.4 | 3.6 | 4.1 | 3.3 |
| | Elongation | % | 29 | 28 | 32 | 31 |
| | Projection height (H) | μm | 1.5 | 1.3 | 1.1 | 1.3 |
| | $H/(WA)^{1/2}$ | — | 2.7 | 2.6 | 2.9 | 2.6 |
| | WB/WA | — | 3.0 | 3.0 | 3.0 | 3.0 |
| | WA/PA | — | 0.2 | 0.2 | 0.5 | 0.2 |
| | DA/PA | — | 15.6 | 15.6 | 15.6 | 15.6 |
| | Evaluation of loss | — | A | A | A | A |
| Slit fiber | Fineness | dtex | 90 | 90 | 90 | 90 |
| | Strength | cN/dtex | 4.5 | 3.4 | 4.3 | 3.2 |
| | Elongation | % | 43.0 | 38 | 39 | 40 |
| | Fiber diameter (DC) | μm | 21.8 | 20.1 | 24.4 | 20.1 |
| | Projection height (HT) | μm | 1.4 | 1.2 | 1.0 | 1.2 |
| | $HT/(WAT)^{1/2}$ | — | 2.8 | 2.7 | 3.0 | 2.7 |
| | WBT/WAT | — | 3.0 | 3.0 | 3.0 | 3.0 |
| | Slit width (WC) | μm | 1.1 | 1.0 | 1.2 | 1.0 |
| | Variation of the slit width | % | 10.3 | 9.2 | 12.1 | 11.1 |
| | Degree of irregularity | — | 1.8 | 1.6 | 1.9 | 1.3 |
| | Evaluation of abrasion resistance | — | A | A | A | A |
| | Water absorption performance | mm | 162 | 151 | 29 | 118 |
| | Water repellency performance | — | 4.4 | 4.3 | 5.0 | 4.6 |
| Note | | | | | No water repellent treatment | |

Examples 10 and 11

The procedure of Example 6 was repeated except that the core-sheath compounding ratio was changed to 70/30 (Example 10) and 90/10 (Example 11).

In Example 10, the core ratio was reduced and this resulted in the deeper slits compared to Example 6, and use of a hydrophilic nylon 6 also resulted in an extremely high water absorption. Since nylon 6 has high alkaline resistance, the slit loss did not occur at all. Use of the nylon 6 having excellent softness resulted in high abrasion resistance and no slit breakage was confirmed despite the deeper slit.

In Example 11, the core ratio was increased and this resulted in the increase of the projection width, and the fiber exhibited excellent durability since self-standing projections remained after the abrasion treatment. In Example 11, the water absorbency and the like somewhat decreased with the decrease in the slit depth compared to Example 6. However, the water absorption height was 4.4 times that of the conventional PET fiber having circular cross-section, and the water absorption performance was sufficient. The results are shown in Table 4.

Examples 12 and 13

Resins comprising PET1 (melt viscosity: 140 Pa·s) used in Example 1 having titanium oxide as the inorganic particles added were prepared. The titanium oxide particles had maximum particle size of 5.0 μm and content of the particles with the particle size of up to 1.0 μm of 64.5% by weight. The titanium oxide content in the resin was 0.3% by weight (PET2), 3.0% by weight (PET3), and 7.0% by weight (PET4).

The procedure of Example 1 was repeated except that the sheath component was PET2 and the core component was PET3 (Example 12) and PET4 (Example 13).

Next, 5 tricot samples (5 cm×5 cm) prepared by knitting these fibers at a 28 gauge half were prepared, and adhered to a square black backing paper of 5 cm×5 cm with its inside cut out at 4 cm×4 cm. The thus adhered samples were measured for their transmittance by using the SM color computer. The anti-see-through property of the samples was evaluated from the average transmittance of the 5 samples by assuming the value for the backing paper (with no sample) as 100 (S: transmittance of up to 5%; A: 5 to 10%; B: 10 to 15%; C: at least 15%). In the evaluation of the anti-see-through property, the anti-see-through property was excellent for both Example 12 (evaluation, A) and Example 13 (evaluation, S), and unique simultaneous realization of the color development and the anti-see-through property was confirmed.

TABLE 4

| | | | Example 10 | Example 11 | Example 12 | Example 13 |
|---|---|---|---|---|---|---|
| Polymer | Core | — | N6 | N6 | PET3 | PET4 |
| | Sheath | — | Copolymerized PET1 | Copolymerized PET1 | PET2 | PET2 |
| | Dissolution speed ratio | — | 30000 or higher | 30000or higher | — | — |
| Core/Sheath area ratio | Core | % | 70 | 90 | 80 | 80 |
| | Sheath | % | 30 | 10 | 20 | 20 |
| Nozzle | Slit number | — | 50 | 50 | 24 | 24 |
| Core-sheath conjugated fiber | Total fineness | dtex | 112 | 112 | 70 | 70 |
| | Filament number | — | 24 | 24 | 36 | 36 |
| | Strength | cN/dtex | 4.0 | 4.7 | 4.3 | 4.1 |
| | Elongation | % | 26 | 33 | 32 | 29 |
| | Projection height (H) | μm | 1.9 | 1.3 | 1.3 | 1.3 |
| | $H/(WA)^{1/2}$ | — | 3.0 | 2.1 | 1.4 | 1.4 |
| | WB/WA | — | 3.0 | 2.6 | 1.4 | 1.4 |
| | WA/PA | — | 0.1 | 0.3 | 0.5 | 0.5 |
| | DA/PA | — | 15.6 | 15.6 | 7.3 | 7.3 |
| | Evaluation of loss | — | A | A | — | — |
| Slit fiber | Fineness | dtex | 78 | 100 | — | — |
| | Strength | cN/dtex | 4.1 | 4.8 | — | — |
| | Elongation | % | 36 | 46 | — | — |
| | Fiber diameter (DC) | μm | 21.8 | 21.8 | — | — |
| | Projection height (HT) | μm | 1.9 | 1.3 | — | — |
| | $HT/(WAT)^{1/2}$ | — | 3.0 | 2.1 | — | — |
| | WBT/WAT | — | 3.0 | 2.6 | — | — |
| | Slit width (WC) | μm | 1.3 | 1.0 | — | — |
| | Variation of the slit width | % | 14.0 | 9.3 | — | — |
| | Degree of irregularity | — | 1.5 | 1.0 | — | — |
| | Evaluation of abrasion resistance | — | A | A | — | — |
| | Water absorption performance | mm | 172 | 142 | — | — |
| | Water repellency performance | — | 4.4 | 5.0 | — | — |
| Note | | | | | No sheath dissolution | No sheath dissolution |

In Example 12 and Example 13, influence of the addition of the inorganic particles was not observed, and good cross-section was formed in both Examples, and the resulting core-sheath conjugated fibers satisfied our requirements as in Example 1. Next, the core-sheath conjugated fibers of Example 12 and Example 13 were dyed under the conditions of 5% owf with malachite green (manufactured by KANTO CHEMICAL CO., INC.), 0.5 ml/L acetic acid, 0.2 g/L sodium acetate, bath ratio of 1:100, temperature of 120° C., and solvent of water without dissolving the sheath component, and the dying was conducted by the method as described above so that dye uptake of the fabric would be the same. 5 or more fabrics were then laminated, and L VALUE was measured by using SM color computer (manufactured by Suga Test Instruments Co., Ltd.) under the conditions that the light did not penetrate through the laminated fabric. Smaller L VALUE corresponds to better color development, and compared to PET3 single fiber (L VALUE: 15.2) at the same fineness, the fibers produced in Example 12 (L VALUE: 13.2) and Example 13 (L VALUE: 13.4) both exhibited good color development.

The invention claimed is:

1. A slit fiber prepared by removing a sheath component from a core-sheath conjugated fiber; the core-sheath conjugated fiber comprising two kinds of polymer, wherein the core-sheath conjugated fiber is characterized in that a core component has projected shapes having projections and grooves alternately in a cross section in a direction perpendicular to a fiber axis, projections are formed continuously in a direction of the fiber axis, and a height (H) of the projections, a width (WA) at a tip of the projections, and a width (WB) of a bottom surface and a distance (PA) between the adjacent projection tips satisfy formulae (1), (2) and (3) at the same time:

$$1.0 \leq H/(WA)^{1/2} \leq 3.0 \ldots \quad (1)$$

$$1.0 \leq WB/WA \leq 3.0 \ldots \quad (2)$$

$$0.1 \leq WA/PA \leq 0.5 \ldots \quad (3);$$

and an area proportion of the core component is at least 70% and up to 90% in the cross section perpendicular to the fiber axis of the core-sheath conjugated fiber, and the slit fiber having slits which are continuous in the direction of the fiber axis; and wherein the height (H) of the projections, the width (WA) at the tip of the projections, and the width (WB) of the bottom surface and the distance (PA) between the adjacent projection tips being measured in the following procedure:

a multifilament comprising a core-sheath conjugated fiber is embedded in an embedding agent and a cross section of the embedded core-sheath conjugated fiber is observed by using a scanning electron microscope (SEM) at a magnification capable of observing at least ten projections protruding from the core component into the sheath component to thereby obtain a two-dimensional picture and ten random projections in a picture are measured for their projection height (H), width of the tip (WA), width of the bottom surface (WB) and the distance (PA) between the adjacent projection tips is a distance between the intersecting points of the center line and the circumcircle of the adjacent two projections by the unit of μm, and measurements were rounded to a first decimal place, and the procedure was repeated for ten pictures and values were averaged and rounded to a first decimal place.

2. A slit fiber having projected shapes having projections and grooves alternately in a cross section in a direction perpendicular to a fiber axis, projections are continuously formed in a direction of the fiber axis, and a height (HT) of the projections, a width (WAT) at a tip of the projections, a width (WBT) of a bottom surface, a slit width (WC) and a fiber diameter (DC) of the slit fiber satisfy the formulae at the same time:

$$1.0 \leq HT/(WAT)^{1/2} \leq 3.0 \quad (4)$$

$$0.7 \leq WBT/WAT \leq 3.0 \quad (5)$$

$$0.02\ WC/DC \leq 0.10 \quad (6);$$

wherein the height (HT) of the projections, the width (WAT) at the tip of the projections, and the width (WBT) of the bottom surface are measured in the following procedure:

the projection height (HT), width at the tip (WAT), and width of the bottom surface (WBT) of the projection are measured by embedding a multifilament comprising the slit fibers in an embedding agent and observing a cross section of the embedded slit fibers by using a scanning electron microscope (SEM) at a magnification capable of observing at least ten projections to thereby obtain a two-dimensional picture and ten random projections in the picture were measured for their projection height (HT), width at the tip (WAT), and width of the bottom surface (WBT) by the unit of μm, and the measurements were rounded to a first decimal place and the procedure was repeated for ten pictures and values were averaged and rounded to a first decimal place; and the slit width (WC) and the fiber diameter (DC) of the slit fiber is measured in the following procedure:

the slit width (WC) is determined by taking an image of a cross section of the slit fiber with a scanning electron microscope (SEM) at a magnification allowing observation of at least ten slits and the slit width (WC) is a value measured by a difference of a distance between adjacent projection tips and a width of the projection tip using ten random slits from the image, and when at least ten slits cannot be observed in one slit fiber, at least ten slits in total are observed by including slits of another slit fiber, the slit width is measured at a unit of μm, a value measured is rounded to the first decimal place, and the procedure is repeated for ten images and values were averaged and rounded to a first decimal place; and the fiber diameter (DC) of the slit fiber is a diameter of a perfect circle which contacts a cross section at two or more points in the cross section of the slit fiber in a direction perpendicular to the fiber axis in a two-dimensional image, the fiber diameter (DC) being measured by embedding a bundle of the slit fibers in an embedding agent, slicing the embedded slit fibers, taking images of the cross section with a stereomicroscope at a magnification capable of observing ten or more fibers, randomly choosing ten fibers in an image, measuring the circumcircle of the fibers in the unit of μm, rounding the measurement to a first decimal place, repeating the procedure for ten images, and calculating a simple number average of a fiber diameter (DC) value measured in each image and its ratio (WC/DC).

3. The slit fiber according to claim 2, wherein the projections are so formed that a distance between adjacent projection tips (slit width WC) in the cross-section perpendicular to the fiber axis has a variation (CV %) of at least 1.0% and up to 20.0%.

4. The slit fiber according to claim 2, wherein degree of irregularity of the cross-sectional shape in the direction perpendicular to the fiber axis is 1.0 to 2.0.

5. The slit fiber according to claim 2, wherein the fiber contains a polyamide as its main component.

6. The slit fiber according to claim 3, wherein degree of irregularity of the cross-sectional shape in the direction perpendicular to the fiber axis is 1.0 to 2.0.

* * * * *